US011058909B2

(12) United States Patent
Adams

(10) Patent No.: US 11,058,909 B2
(45) Date of Patent: Jul. 13, 2021

(54) WEIGHTLIFTING MACHINE

(71) Applicant: Coulter Ventures, LLC., Columbus, OH (US)

(72) Inventor: Bryan Adams, Columbus, OH (US)

(73) Assignee: Coulter Ventures, LLC., Columbus, OH (US)

( * ) Notice: Subject to any disclaimer, the term of this patent is extended or adjusted under 35 U.S.C. 154(b) by 0 days.

(21) Appl. No.: 16/405,611

(22) Filed: May 7, 2019

(65) Prior Publication Data

US 2020/0038704 A1 Feb. 6, 2020

Related U.S. Application Data

(60) Provisional application No. 62/723,200, filed on Aug. 27, 2018, provisional application No. 62/668,005, filed on May 7, 2018.

(51) Int. Cl.

| | |
|---|---|
| ***A63B 21/062*** | (2006.01) |
| ***A63B 21/00*** | (2006.01) |
| ***A63B 21/072*** | (2006.01) |

(52) U.S. Cl.

CPC ..... *A63B 21/0626* (2015.10); *A63B 21/0726* (2013.01); *A63B 21/154* (2013.01); *A63B 21/4033* (2015.10); *A63B 21/4035* (2015.10)

(58) Field of Classification Search

CPC ... A63B 21/06; A63B 21/062; A63B 21/0622; A63B 21/0624; A63B 21/0626; A63B 21/0628; A63B 21/063; A63B 21/0632; A63B 21/072; A63B 21/0724; A63B 21/0728; A63B 21/075; A63B 21/08; A63B 21/151; A63B 21/152; A63B 21/154; A63B 21/4001; A63B 21/4011; A63B 21/4013; A63B 21/4015; A63B 21/4034; A63B 21/4035; A63B 21/4041; A63B 21/4045

(Continued)

(56) References Cited

U.S. PATENT DOCUMENTS

| | | | |
|---|---|---|---|
| 4,286,782 | A | 9/1981 | Fuhrhop |
| 4,339,125 | A | 7/1982 | Uyeda et al. |

(Continued)

FOREIGN PATENT DOCUMENTS

| | | | |
|---|---|---|---|
| EP | 3295998 | A1 | 3/2018 |
| FR | 2630652 | A1 | 11/1989 |

(Continued)

OTHER PUBLICATIONS

Sep. 25, 2019—(WO) ISR and WO—App PCT/US20190/031156.

(Continued)

*Primary Examiner* — Garrett K Atkinson
*Assistant Examiner* — Zachary T Moore
(74) *Attorney, Agent, or Firm* — Banner & Witcoff, Ltd.

(57) ABSTRACT

A weightlifting machine includes a carriage support, a carriage moveably mounted on the carriage support and configured to move along the carriage support, and a locking mechanism that is moveable between a locking position, where the locking mechanism engages the carriage and supports the carriage at an elevated position above a lowermost position of the carriage, and a release position, where the locking mechanism does not engage the carriage, and the carriage is free to move below the elevated position.

24 Claims, 26 Drawing Sheets

(58) Field of Classification Search
USPC ..... 482/101
See application file for complete search history.

(56) References Cited

U.S. PATENT DOCUMENTS 4,492,375 A 1/1985 Connelly
4,527,797 A 7/1985 Slade, Jr. et al.
4,582,320 A 4/1986 Shaw
4,635,934 A 1/1987 Roethke
D299,502 S 1/1989 Streiler
4,795,149 A * 1/1989 Pearson ..... A63B 21/078 482/133
4,856,775 A 8/1989 Colledge et al.
D306,467 S 3/1990 Smith
4,907,798 A 3/1990 Burchatz
5,050,868 A 9/1991 Pearson
5,116,297 A 5/1992 Stonecipher
5,184,992 A * 2/1993 Banks ..... A63B 21/06 482/104
5,273,506 A 12/1993 Dawson, Jr.
D358,623 S 5/1995 Macasieb
5,529,558 A 6/1996 Koenig
5,569,133 A 10/1996 Vittone
5,688,216 A 11/1997 Mauriello
5,722,922 A 3/1998 Watterson et al.
5,954,619 A 9/1999 Petrone
5,971,897 A 10/1999 Olson et al.
D437,370 S 2/2001 Webber et al.
D438,267 S 2/2001 Webber et al.
6,217,483 B1 4/2001 Kallassy
6,220,988 B1 4/2001 Williams
6,238,323 B1 5/2001 Simonson
6,261,205 B1 7/2001 Elefson
6,394,935 B1 5/2002 Lake
6,447,430 B1 9/2002 Webb et al.
6,482,139 B1 11/2002 Haag
D495,380 S 8/2004 Ceppo
D502,515 S 3/2005 Carter
D504,164 S 4/2005 Ceppo
7,131,937 B2 11/2006 Skilken et al.
D550,790 S 9/2007 Staten
D550,791 S 9/2007 Rogers et al.
D550,792 S 9/2007 Rogers et al.
D550,793 S 9/2007 Rogers et al.
D551,306 S 9/2007 Rogers et al.
D557,758 S 12/2007 Fedriga et al.
7,488,277 B1 2/2009 Knapp
7,549,950 B1 6/2009 Lundquist et al.
D629,472 S 12/2010 Rhodes
D636,038 S 4/2011 Henniger
D636,040 S 4/2011 Henniger
7,918,770 B1 4/2011 Hoole
8,057,368 B1 11/2011 Lyszczarz
8,096,926 B1 1/2012 Batca
RE43,397 E 5/2012 Rogers et al.
8,172,733 B1 5/2012 Batca
8,834,327 B1 9/2014 George, Jr.
8,876,673 B2 11/2014 Inglut
8,876,675 B2 11/2014 Califano
9,011,301 B2 4/2015 Balandis et al.
9,017,228 B2 4/2015 Hodges
9,028,381 B2 5/2015 Mestemaker
D731,601 S 6/2015 Bradley et al.
D734,410 S 7/2015 Childs et al.
D735,819 S 8/2015 Louis
D735,820 S 8/2015 Alenaddaf
D735,821 S 8/2015 Alenaddaf
D737,387 S 8/2015 De Siqueira Indio da Costa et al.
9,095,742 B2 8/2015 Henniger et al.
D742,979 S 11/2015 Post
9,192,799 B2 11/2015 Alenaddaf
D746,387 S 12/2015 Alessandri et al.
9,278,246 B2 3/2016 Tambornino et al.
9,289,638 B2 3/2016 Towley, III et al.
9,302,139 B2 4/2016 Habing et al.
D755,908 S 5/2016 James
D757,189 S 5/2016 Colburn
9,327,161 B1 5/2016 Maher et al.
9,421,413 B2 8/2016 Staten et al.
D769,881 S 10/2016 Lazzi et al.
9,486,660 B2 11/2016 Hoole
9,526,938 B2 * 12/2016 Chen ..... A63B 21/062
9,610,490 B2 4/2017 Tambornino et al.
D787,237 S 5/2017 Bowman et al.
D788,861 S 6/2017 Campanaro et al.
9,669,251 B2 6/2017 Jones-Guinasso
9,713,741 B1 7/2017 Tolliver
D794,144 S 8/2017 Abelbeck et al.
D803,126 S 11/2017 Foley
D806,808 S 1/2018 Gregory
D808,475 S 1/2018 Meredith et al.
9,895,572 B2 2/2018 Donato et al.
D818,547 S 5/2018 Meredith et al.
D841,014 S 2/2019 Laudadio et al.
10,293,206 B2 5/2019 Kamins
D852,291 S 6/2019 Meredith et al.
10,307,634 B2 6/2019 Young
D852,907 S 7/2019 Sergakis
D853,404 S 7/2019 Bowman et al.
D854,637 S 7/2019 Adams
D883,406 S 5/2020 Sergakis
D888,850 S 6/2020 Smith, Jr.
D893,639 S 8/2020 Henniger et al.
D896,326 S 9/2020 Adams
D898,137 S 10/2020 Carmichael et al.
10,792,532 B1 10/2020 Hall et al.
D903,793 S 12/2020 Henniger et al.
2003/0115955 A1 6/2003 Keiser
2005/0054493 A1 3/2005 Skilken et al.
2005/0202941 A1 9/2005 Vaes
2006/0160677 A1 * 7/2006 Piane, Jr. ..... A63B 23/1209 482/101
2006/0183607 A1 8/2006 Collias
2006/0247097 A1 11/2006 La Voie et al.
2006/0252615 A1 11/2006 Melcer
2007/0155594 A1 7/2007 Rogers et al.
2007/0155595 A1 7/2007 Rogers et al.
2007/0155596 A1 7/2007 Rogers et al.
2007/0161468 A1 7/2007 Yanagisawa et al.
2008/0312051 A1 12/2008 Manyseng
2009/0143203 A1 6/2009 Knapp
2010/0216610 A1 8/2010 Gedeon-Janvier
2010/0292057 A1 11/2010 Dunn
2012/0119040 A1 5/2012 Ergun et al.
2012/0289384 A1 11/2012 Staten et al.
2012/0329613 A1 12/2012 Schiano
2013/0035220 A1 2/2013 Adams
2013/0296143 A1 11/2013 Staten et al.
2013/0296146 A1 11/2013 Staten et al.
2014/0087928 A1 3/2014 Luedeka
2014/0256517 A1 9/2014 Poppinga
2014/0296040 A1 10/2014 Mobley
2015/0011370 A1 1/2015 Henniger
2015/0014212 A1 1/2015 Beaver et al.
2015/0038300 A1 2/2015 Forhan et al.
2015/0059257 A1 3/2015 Beaver et al.
2015/0065316 A1 3/2015 Towley, III et al.
2015/0083681 A1 3/2015 Childs
2015/0159804 A1 6/2015 Bowman et al.
2015/0182773 A1 7/2015 Olson et al.
2015/0196119 A1 7/2015 Henniger
2015/0290489 A1 10/2015 Simmons
2015/0352395 A1 12/2015 Gregory
2016/0175639 A1 6/2016 Thomson
2016/0213967 A1 7/2016 Habing et al.
2017/0007877 A1 1/2017 Leipheimer
2017/0246496 A1 8/2017 Nelson et al.
2017/0246504 A1 * 8/2017 Simmons ..... A63B 21/00065
2017/0266480 A1 9/2017 Bruni et al.
2018/0117382 A1 5/2018 Johanson et al.
2018/0178051 A1 6/2018 Shaw, Jr.
2018/0311522 A1 11/2018 Schmidt et al.
2018/0353795 A1 12/2018 Ostmeyer et al.

(56) References Cited

U.S. PATENT DOCUMENTS

| | | | |
|---|---|---|---|
| 2019/0240521 | A1 | 8/2019 | Staten |
| 2019/0269992 | A1 | 9/2019 | Dunahay |
| 2019/0275363 | A1 | 9/2019 | Jones et al. |
| 2020/0038704 | A1 | 2/2020 | Adams |
| 2020/0114195 | A1 | 4/2020 | Henniger et al. |
| 2020/0179744 | A1 | 6/2020 | Arroyo |

FOREIGN PATENT DOCUMENTS

| | | | |
|---|---|---|---|
| GB | 2346808 | A | 8/2000 |
| KR | 200466889 | Y1 | 5/2013 |
| KR | 20140060130 | A | 5/2014 |
| WO | 9842411 | A1 | 10/1998 |
| WO | 201893699 | A1 | 5/2018 |

OTHER PUBLICATIONS

Photo from https://web.archive.org/web/20170112075250/https:/mydynamicfitness.com, dated Jan. 12, 2017.
Screenshots from https://www.youtube.com/watch?v=A4xv8OhVbzl, dated May 17, 2018.
The belt squat machine by legend fitness dated Oct. 11, 2016. Found online [Sep. 13, 2019]; https://www.legendfitness.com/2016/10/the-belt-squat-machine/.
Belt Squat by bells of steel dated no date given. Found online [Sep. 13, 2019] http://www.bellsofsteel.us/product/belt-squat-machine/.
D8X by gym equip dated no date given. Found online [Sep. 13, 2019] https://www.gymequip.eu/product/belt-squat-machine/.

* cited by examiner

WEIGHTLIFTING MACHINE

CROSS-REFERENCE TO RELATED APPLICATIONS

This application is a non-provisional of, and claims priority to, U.S. Provisional Application No. 62/668,005, filed May 7, 2018, and U.S. Provisional Application No. 62/723,200, filed Aug. 27, 2018, both of which prior applications are incorporated by reference herein in their entireties.

FIELD OF THE INVENTION

This disclosure relates to machines for weightlifting and other exercise, and more specifically to weightlifting machines designed for squat lifting and weight racks including such machines.

BACKGROUND

Various different types of squat machines exist, which provide users the ability to perform a squat weightlifting exercise, or potentially other weightlifting exercises as well. One such type of squat machine is a "belt squat" machine, in which a belt or other harness fastened to the user's waist and/or torso is connected by a series of cables and pulleys to a weight to be lifted. Such existing belt squat machines and other squat machines are typically standalone machines with relatively large footprints, using multiple support posts to suspend a moveable weight for lifting. Additionally, existing belt squat machines can be difficult or awkward for a user to operate while using the machine for exercise. Thus, there is a need for squat machine structures that provide compact structures with improved operation and safety, which can be integrated into existing weight racks.

The present disclosure is provided to address this need and other needs in existing squat machines and weight racks including such machines. A full discussion of the features and advantages of the present invention is deferred to the following detailed description, which proceeds with reference to the accompanying drawings.

BRIEF SUMMARY

Aspects of the disclosure relate to a weightlifting machine that includes a user-engaging device configured to be engaged by a user during an exercise on the weightlifting machine, a carriage support including a track extending upward from a base, and a carriage moveably mounted on the carriage support and configured to move vertically along the track, where the carriage is configured for engaging a weight for resistance against vertical movement. The machine also includes a cable system including a cable operably connected to the user-engaging device and the carriage and one or more pulleys connected to the weightlifting machine to guide a path of the cable, such that movement of the user-engaging device by the user during the exercise moves the carriage vertically along the track via the cable system. The machine further includes a locking mechanism including a locking member that is moveable between a locking position, where the locking member engages the carriage and supports the carriage at an elevated position above a lowermost position of the carriage, and a release position, where the locking member does not engage the carriage, and the carriage is free to move below the elevated position.

According to one aspect, the carriage includes a weight mount configured for engaging the weight in the form of a free weight supported by the weight mount and/or configured for engaging the weight in the form of a resistance band. The base may have a peg extending outwardly from the base, and the peg and the weight mount may be configured to engage the resistance band such that movement of the carriage away from the base stretches the resistance band.

According to another aspect, the machine includes a platform configured to support the user during the exercise and a supporting assembly supporting the platform, where at least the base of the carriage support is connected to the supporting assembly, and the locking mechanism is connected to the supporting assembly.

According to a further aspect, the carriage support includes an upright rail defining the track, where the upright rail is hollow, and the cable of the cable system has an ascending cable section extending vertically within the hollow upright rail.

According to yet another aspect, the locking member is moveable by pivoting between the locking position and the release position, and the locking member includes an engagement part configured to engage and support the carriage at the elevated position, with the engagement part having a notch configured to receive an engagement member of the carriage.

Additional aspects of the disclosure relate to a weightlifting machine that includes a user-engaging device configured to be engaged by a user during an exercise on the weightlifting machine, a carriage support having a vertical rail extending upward from a base and defining a track, where the vertical rail is hollow and has a center passage that extends vertically within the vertical rail, and a carriage moveably mounted on the carriage support and configured to move vertically along the track, where the carriage is configured for engaging a weight for resistance against vertical movement. The machine also includes a cable system including a cable operably connected to the user-engaging device and the carriage and one or more pulleys connected to the weightlifting machine to guide a path of the cable, such that movement of the user-engaging device by the user during the exercise moves the carriage vertically along the track via the cable system. In this configuration, the cable of the cable system has an ascending cable section extending vertically within the center passage of the vertical rail.

According to one aspect, the machine includes a locking mechanism having a locking member that is moveable between a locking position, where the locking member engages the carriage and supports the carriage at an elevated position above a lowermost position of the carriage, and a release position, where the locking member does not engage the carriage, and the carriage is free to move below the elevated position.

According to another aspect, the cable has a user-engaging device cable section that extends from the user-engaging device, a lateral cable section extending in a lateral direction from the user-engaging device cable section to the ascending cable section, and a descending cable section extending downward from the ascending cable section to the carriage. In one configuration, the at least one pulley of the cable system includes a first pulley between the user-engaging device cable section and the lateral cable section, a second pulley between the lateral cable section and the ascending cable section, and a third pulley between the ascending cable section and the descending cable section.

According to a further aspect, the cable has a descending cable section extending downward from the ascending cable section to the carriage, and the at least one pulley includes a first pulley located between the ascending cable section and the descending cable section, and wherein the descending cable section extends outside the central passage of the vertical rail.

According to yet another aspect, the machine further includes a platform configured to support the user during the exercise and a supporting assembly supporting the platform, where at least the base of the carriage support is connected to the supporting assembly, and the cable extends downward through a slot in the platform and laterally from the slot to the ascending cable section.

According to a still further aspect, the carriage includes a weight mount configured for engaging the weight in the form of a free weight supported by the weight mount and/or configured for engaging the weight in the form of a resistance band. The base may have a peg extending outwardly from the base, and the peg and the weight mount are configured to engage the resistance band such that movement of the carriage away from the base stretches the resistance band.

Further aspects of the disclosure relate to a weightlifting machine that includes a carriage support having a track, a carriage moveably mounted on the carriage support and configured to move vertically along the track, where the carriage is configured for engaging a weight for resistance against vertical movement during an exercise on the weightlifting machine, and a locking mechanism having a locking member that is moveable by pivoting between a locking position and a release position. In the locking position, the locking member engages the carriage and supports the carriage at an elevated position above a lowermost position of the carriage, and in the release position, the locking member does not engage the carriage, and the carriage is free to move below the elevated position.

According to one aspect, the locking mechanism further includes a pivot connection configured for connection to a supporting assembly and a pivoting body connected to the pivot connection such that the locking mechanism is pivotable about the pivot connection, where the locking member is connected to the pivoting body and extends upward from the pivoting body. In one configuration, the pivoting body includes a base member that extends horizontally and a vertical member connected to the base member and extending upward from the base member, where the vertical member has a handle configured for gripping by a user to pivot the locking mechanism between the locking position and the release position. In an additional configuration, the pivoting body further includes a second vertical member connected to the base member and extending upward from the base member, where the second vertical member has a second handle configured for gripping by a user to pivot the locking mechanism between the locking position and the release position, and where the vertical member is spaced from the second vertical member, and the locking member is positioned between the vertical member and the second vertical member. In a further configuration, the vertical member is connected to the pivot connection, and the locking mechanism further includes a second pivot connection. In this configuration, the second vertical member is connected to the second pivot connection such that the locking mechanism is pivotable about the pivot connection and the second pivot connection, and the base member extends horizontally between the vertical member and the second vertical member. In an another configuration, the locking member may include an engagement part configured to engage and support the carriage at the elevated position, the engagement part having a notch configured to receive an engagement member of the carriage.

According to another aspect, the machine further includes a user-engaging device configured to be engaged by a user during the exercise, a cable system having a cable operably connected to the user-engaging device and the carriage, such that movement of the user-engaging device by the user during the exercise moves the carriage vertically along the track via the cable system, a platform configured to support the user during the exercise, and a supporting assembly supporting the platform. In this configuration, the locking mechanism further includes a pivot connection connected to the supporting assembly and a pivoting body connected to the pivot connection such that the locking mechanism is pivotable about the pivot connection, where the locking member is connected to the pivoting body.

According to a further aspect, the machine also includes a supporting assembly supporting the platform, the supporting assembly having a vertical frame member, and the locking mechanism further includes a pivot connection connected to the supporting assembly and a pivoting body connected to the pivot connection, such that the locking mechanism is pivotable about the pivot connection. In this configuration, the locking member is connected to the pivoting body, and the vertical frame member is configured to abut the pivot body to limit a range of motion of the locking mechanism away from the locking position.

According to yet another aspect, the locking mechanism further includes motion limiting structures configured to limit a range of motion of the locking mechanism away from the locking position and away from the release position.

Still further aspects of the disclosure relate to a weightlifting machine that includes a carriage support, a carriage moveably mounted on the carriage support and configured to move vertically on the carriage support, where the carriage is configured for engaging a weight for resistance against vertical movement during an exercise on the weightlifting machine, and a locking mechanism that includes a base member, a locking member having an arm extending upward from the base member and an engagement part connected to the arm, and a vertical member connected to the base member and extending upward from the base member, the vertical member having a handle. The locking mechanism is moveable by manipulation of the handle to move the locking member between a locking position, where the engagement part engages the carriage and supports the carriage at an elevated position above a lowermost position of the carriage, and a release position, where the engagement part does not engage the carriage, and the carriage is free to move below the elevated position.

According to one aspect, the locking mechanism further includes a second vertical member connected to the base member and extending upward from the base member, where the second vertical member has a second handle configured for gripping by a user to move the locking mechanism between the locking position and the release position, and wherein the vertical member is spaced from the second vertical member. In one configuration, the locking member is positioned between the vertical member and the second vertical member. In another configuration, the base member extends horizontally between the vertical member and the second vertical member.

According to another aspect, the engagement part has a notch configured to receive an engagement member of the carriage and/or the engagement part extends outwardly from the arm.

According to a further aspect, the engagement part is adjustably connected to the arm, such that the engagement part is configured to be mounted at a plurality of different positions along a length of the arm.

According to yet another aspect, the machine also includes a user-engaging device configured to be engaged by a user during the exercise, a cable system having a cable operably connected to the user-engaging device and the carriage, such that movement of the user-engaging device by the user during the exercise moves the carriage vertically along the track via the cable system, a platform configured to support the user during the exercise, and a supporting assembly supporting the platform, where the locking mechanism is moveably connected to the supporting assembly.

Additional aspects of the disclosure relate to a weightlifting machine that includes a carriage support, a carriage moveably mounted on the carriage support and configured to move along the carriage support, and a locking mechanism that is moveable between a locking position, where the locking mechanism engages the carriage and supports the carriage at an elevated position above a lowermost position of the carriage, and a release position, where the locking mechanism does not engage the carriage, and the carriage is free to move below the elevated position.

Further aspects of the disclosure relate to a weightlifting machine that includes a user-engaging device configured to be engaged by a user during an exercise on the weightlifting machine, a platform configured to support the user during the exercise, the platform having a slot, a weight configured to be lifted during the exercise, and a cable system having a cable operably connected to the user-engaging device and the weight and one or more pulleys connected to the weightlifting machine to guide a path of the cable. The cable system is configured such that movement of the user-engaging device by the user during the exercise lifts the weight through the cable system, and the cable system has a first pulley located proximate the slot of the platform, where the cable engages the first pulley and extends through the slot to connect to the user-engaging device. A friction reducing structure positioned along at least a portion of a periphery of the slot and configured to engage the cable.

According to one aspect, the friction reducing structure includes one or more rollers positioned along the at least a portion of the periphery of the slot and configured to engage the cable.

According to another aspect, the slot is elongated between a first end and a second end opposite the first end, and the periphery of the slot includes the first and second ends and two sides extending between the first and second ends. The first pulley is located at the first end of the slot, and the friction reducing structure includes one or more rollers positioned on one or more of the second end and the two sides of the slot.

According to a further aspect, the slot is elongated between a first end and a second end opposite the first end, and the periphery of the slot includes the first and second ends and two sides extending between the first and second ends. The first pulley is located at the first end of the slot, and the friction reducing structure includes a plurality of rollers positioned at second end and on the two sides of the slot.

According to yet another aspect, the slot is elongated between a first end and a second end opposite the first end, and the periphery of the slot includes the first and second ends and two sides extending between the first and second ends. The first pulley is located at the first end of the slot, and the friction reducing structure is positioned at second end and on the two sides of the slot.

According to a still further aspect, the weight is engaged with a carriage mounted on a carriage support and moveable along the carriage support, and the cable system is connected to the carriage such that movement of the user-engaging device by the user during the exercise lifts the carriage and the weight through the cable system.

Other aspects of the disclosure relate to a carriage for use with a weightlifting machine having a carriage support, the carriage including a carriage body having a central passage configured for receiving the carriage support therethrough, the carriage body having a front end and a rear end located on opposite sides of the central passage and a plurality of rollers rotatably connected to the carriage body and positioned within the central passage, where the plurality of rollers are configured to engage front and rear sides of the carriage support, and where the carriage is configured to moveable along the carriage support. The carriage also includes a weight mount connected to the carriage body at the rear end of the carriage body, where the weight mount is configured for engaging a weight for resistance against vertical movement of the carriage, an engagement member connected to the carriage body at the front end of the carriage body, where the engagement member is configured to be engaged by an engagement part of the weightlifting machine to selectively support the carriage in an elevated position, and a cable connection configured for connecting a cable to the carriage body. The cable connection may be located at the rear end of the carriage body. Aspects of the disclosure also relate to a weightlifting machine including a carriage support with a carriage as described herein mounted on the carriage support.

According to one aspect, the weight mount includes a beam extending laterally outward from first and second lateral sides of the carriage body, and the cable connection is located on the beam. In one configuration, the carriage body includes first and second plates located on the first and second lateral sides of the carriage body, such that the central passage is defined between the first and second plates and the rollers extend between the first and second plates, and the beam is received within recesses on the first and second plates.

According to another aspect, the carriage body includes first and second plates located on opposite lateral sides of the carriage body, such that the central passage is defined between the first and second plates, and the rollers extend between the first and second plates. In one configuration, the first and second plates each have a projection extending outward at the front end of the carriage body, and the engagement member includes a bar extending connected to the first and second plates at the projections and extending between the first and second plates.

According to a further aspect, the plurality of rollers includes a first roller configured to engage one of the front and rear sides of the carriage support and a second roller configured to engage the other of the front and rear sides of the carriage support, where the second roller is fixed and the first roller is moveable horizontally toward and away from the second roller to adjust a spacing between the first and second rollers. The carriage body has a slot receiving an axle of the first roller, a threaded aperture intersecting the slot, and a set screw received in the threaded aperture, and the set screw is configured to adjust the spacing between the first and second rollers by threading advancement and retreat, thereby moving the axle within the slot toward or away from the second roller.

Other aspects of the disclosure relate to a locking mechanism for use with a weightlifting machine having a moveable weight assembly, the locking mechanism including a pivot body having a base member extending over a horizontal length and a first vertical member and a second vertical member connected to the base member and extending upward from the base member, where the first vertical member is spaced from the second vertical member along the horizontal length of the base member, and a locking member having an arm connected to the base member and extending upward from the base member at a location between the first and second vertical members along the horizontal length of the base member and an engagement part connected to the arm, where the engagement part has a notch configured to receive a portion of the moveable weight assembly. The mechanism further includes a pivot connection connected to the pivot body and configured for connection to the weightlifting machine to pivotably connect the pivot body to the weightlifting machine, where the pivot body and the locking member are configured to pivot together about the pivot connection. The engagement part may extend outwardly from the arm. Aspects of the disclosure also relate to a weightlifting machine including a locking mechanism as described herein along with a moveable weight assembly.

According to one aspect, the pivot connection defines a pivot axis that extends parallel to the base member of the pivot body.

According to another aspect, the mechanism also includes a second pivot connection connected to the pivot body and spaced from the pivot body along the horizontal length of the base member, the second pivot connection configured for connection to the weightlifting machine to pivotably connect the pivot body to the weightlifting machine, where the pivot body and the locking member are configured to pivot together about the pivot connection and the second pivot connection. In one configuration, the pivot connection is connected to the first vertical member of the pivot body and the second pivot connection is connected to the second vertical member of the pivot body. In another configuration, the first and second vertical members further extend downward from the base member, and the pivot connection and the second pivot connection are respectively connected to the first and second vertical members below the base member.

According to a further aspect, the engagement part is adjustably connected to the arm, such that the engagement part is configured to be mounted at a plurality of different positions along a length of the arm. In one configuration, the locking member further includes a bracket fixedly connected to the engagement part, the bracket having a cavity receiving the arm therein, and a pin configured to engage the bracket and the arm at the plurality of different positions along the length of the arm to adjustably connect the bracket and the engagement part to the arm at any of the plurality of different positions.

Other aspects of the disclosure relate to a weight rack assembly having a weightlifting machine as described herein connected thereto or a method of assembling a weight rack assembly including connecting a weightlifting machine as described herein to the weight rack assembly.

Other features and advantages of the disclosure will be apparent from the following description taken in conjunction with the attached drawings.

BRIEF DESCRIPTION OF THE DRAWINGS

To allow for a more full understanding of the present disclosure, it will now be described by way of example, with reference to the accompanying drawings in which.

DETAILED DESCRIPTION

Figure 1:
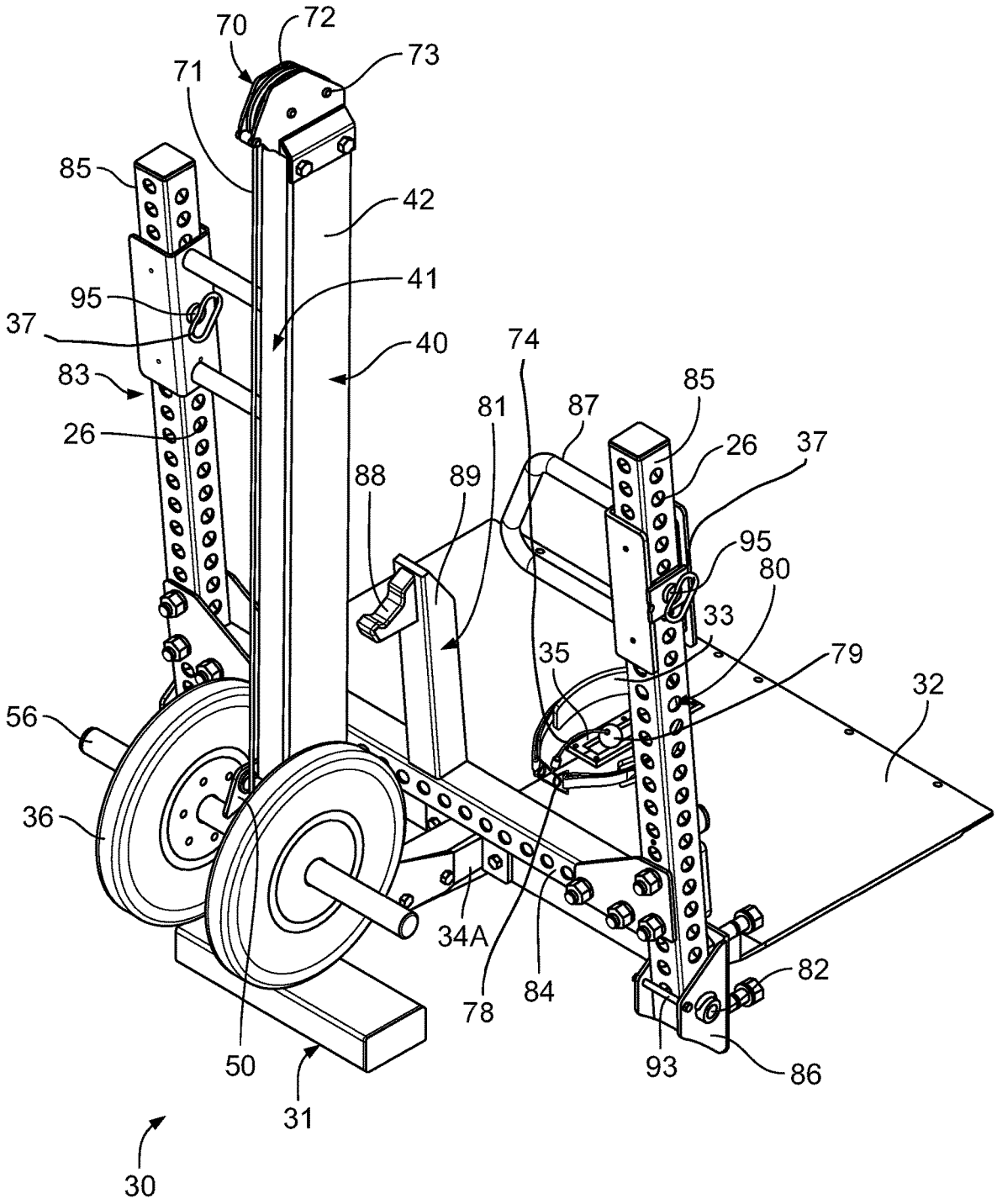
FIG. 1 is a rear left perspective view of a weightlifting machine according to aspects of the disclosure, in the form of a squat machine.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Referring to FIGS. 1-15, there is shown a weightlifting machine in the form of a squat machine 30 that includes a support frame 31, a platform 32, a user-engaging device in the form of a harness 33, a carriage support 40, a weight carriage 50 moveably mounted on the carriage support 40, a cable system 70 operably connecting the harness 33 to the weight carriage 50, and a locking mechanism 80 configured to selectively hold and/or support the weight carriage 50. The machine 30 is configured such that the harness 33 is connected to the user's body in a belt-like configuration (not shown), and moving the harness 33 upward (shown by Arrow A in FIG. 5), such as by a squat lifting motion, pulls the weight carriage 50 upward along the carriage support 40 via the cable system 70, with the weight of the weight carriage 50 providing resistance to the user in this motion. It is understood that moving the harness 33 downward permits the weight carriage 50 to move downward along the carriage support 40. The components of the machine 30 are described in greater detail below.

Figure 16:
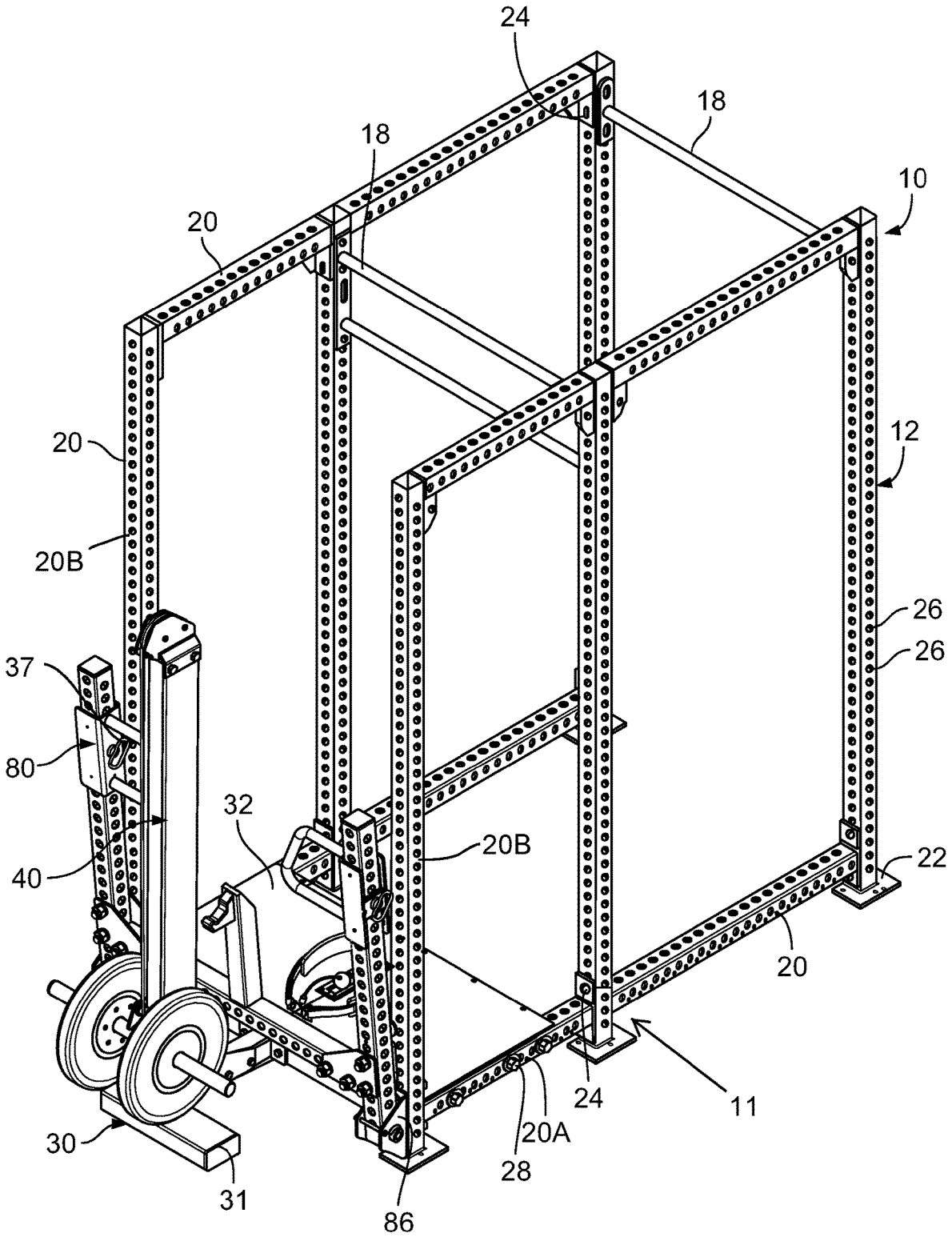
FIG. 16 is a rear left perspective view of a weight rack assembly according to aspects of the disclosure, including the weightlifting machine of FIG. 1.
Figure 17:
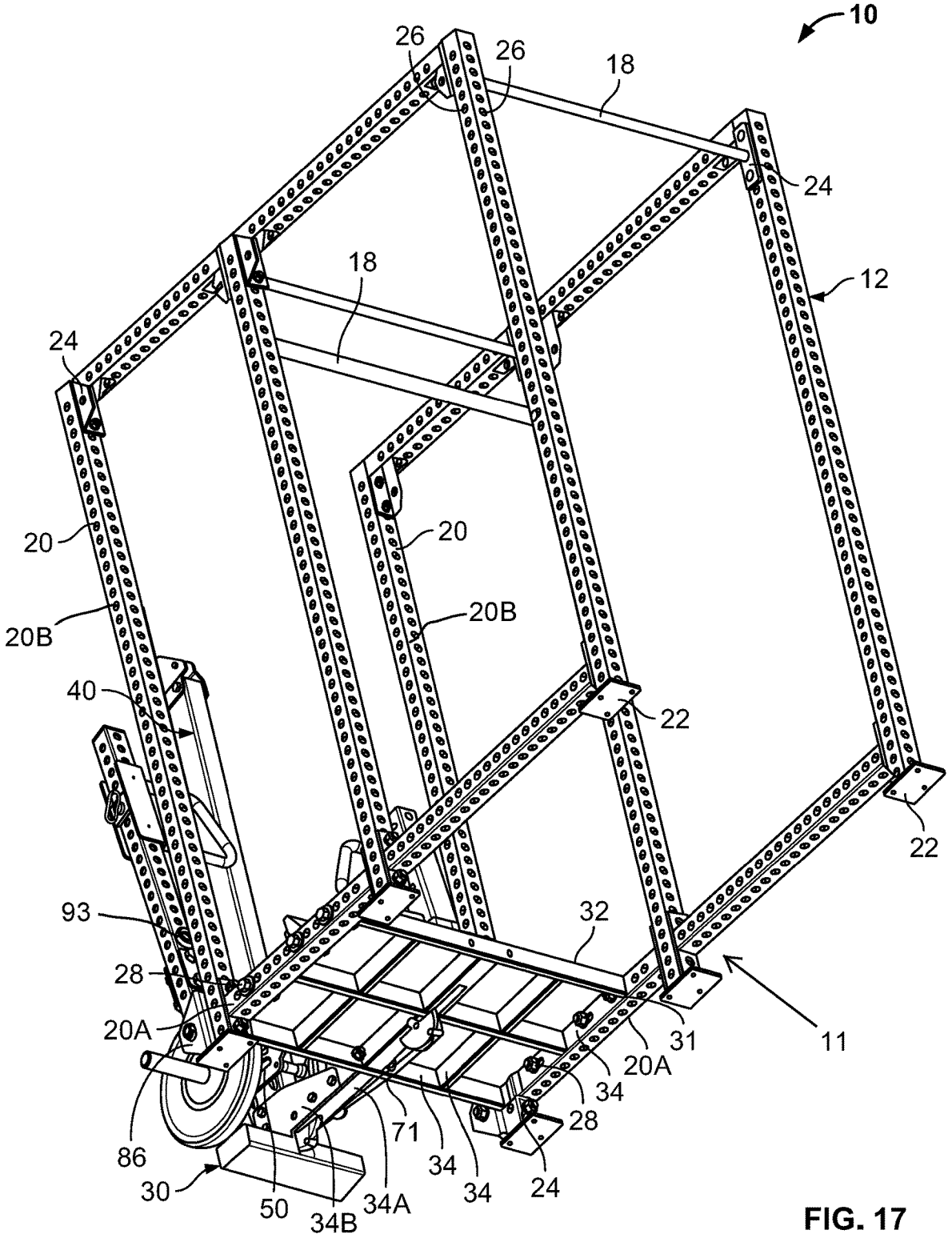
FIG. 17 is a bottom front left perspective view of the weight rack assembly of FIG. 16.
Figure 33:
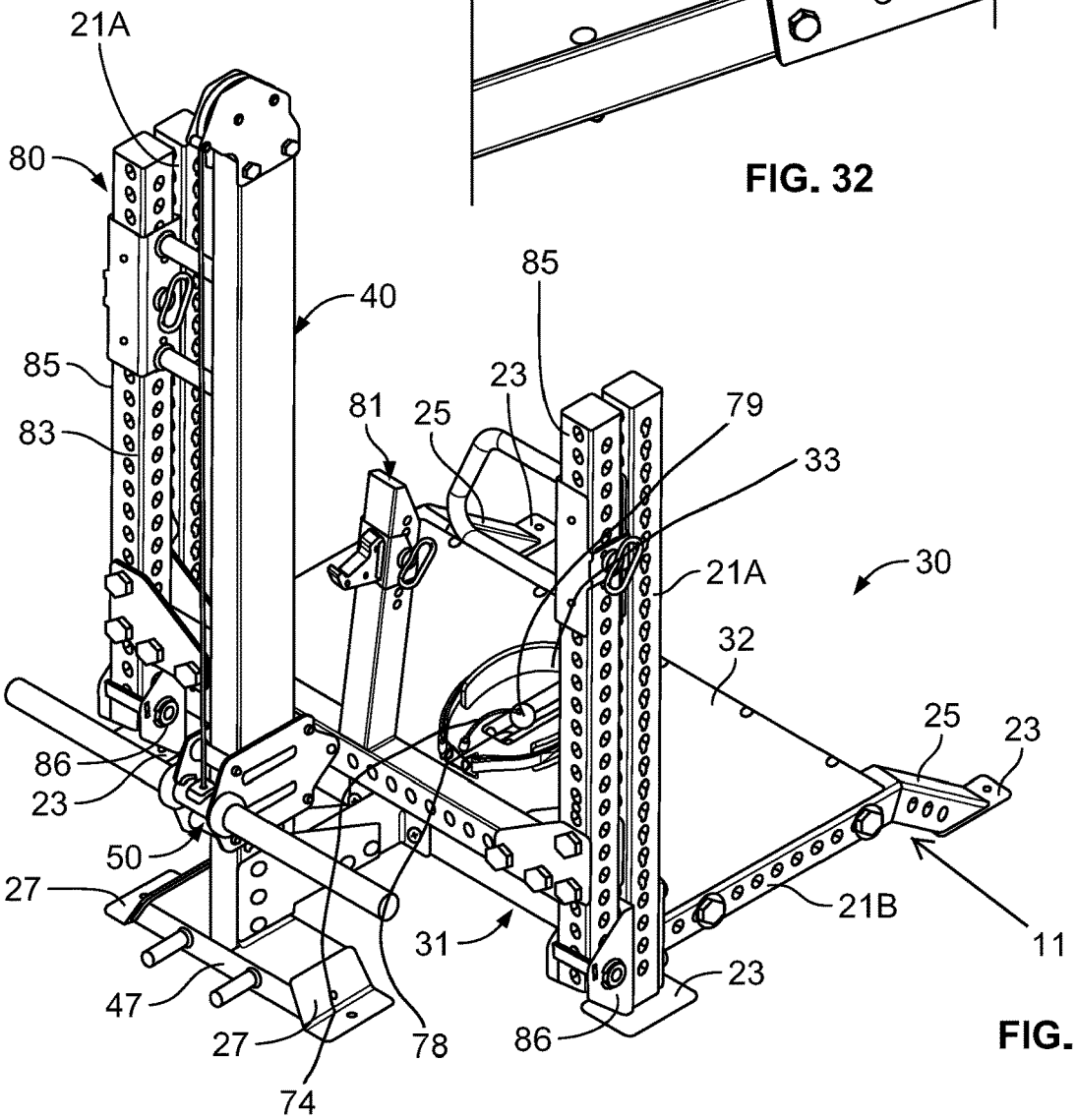
FIG. 33 is a rear left perspective view of another embodiment of a weightlifting machine according to aspects of the disclosure, in the form of a stand-alone squat machine.

The support frame 31 includes a plurality of support frame members 34 that engage the ground or resting surface and support the other components of the machine 30. Some of the support frame members 34 are formed in a grid-like reinforcing structure beneath the platform 32 in order to provide stable support for the platform 32. One of the support frame members 34A extends from the front side of the platform 32 to the carriage support 40 and connects the carriage support 40 to the platform 32. Bracing members 34B are also connected to the support frame member 34A and the carriage support 40 to reinforce the connection between these structures and to stabilize the carriage support 40. As described in greater detail below, the support frame 31 in the embodiment of FIGS. 1-15 is configured for connection to a weight rack assembly 10 as shown in FIGS. 16-17, and this connection partially supports the machine 30. Several of the support frame members 34 have structures for connection of the machine 30 to the rack assembly 10 as described herein, including holes for receiving fasteners. In this configuration, the support frame 31 and the rack assembly 10 may be considered to be parts of a supporting assembly 11 that supports the other components of the machine 30. In another embodiment, the support frame 31 may have additional support frame members 34, including additional feet or other ground-engaging structures to provide the machine 30 as a stand-alone structure independent of a rack assembly 10, such that the support frame 31 alone constitutes the entire supporting assembly 11. Such additional frame members 34 may resemble the feet 22 and vertical frame members 20 of the rack assembly 10 in FIGS. 16-17, described in greater detail below. FIG. 33, described in greater detail below, illustrates one such embodiment of a stand-alone machine 30.

Figure 2:
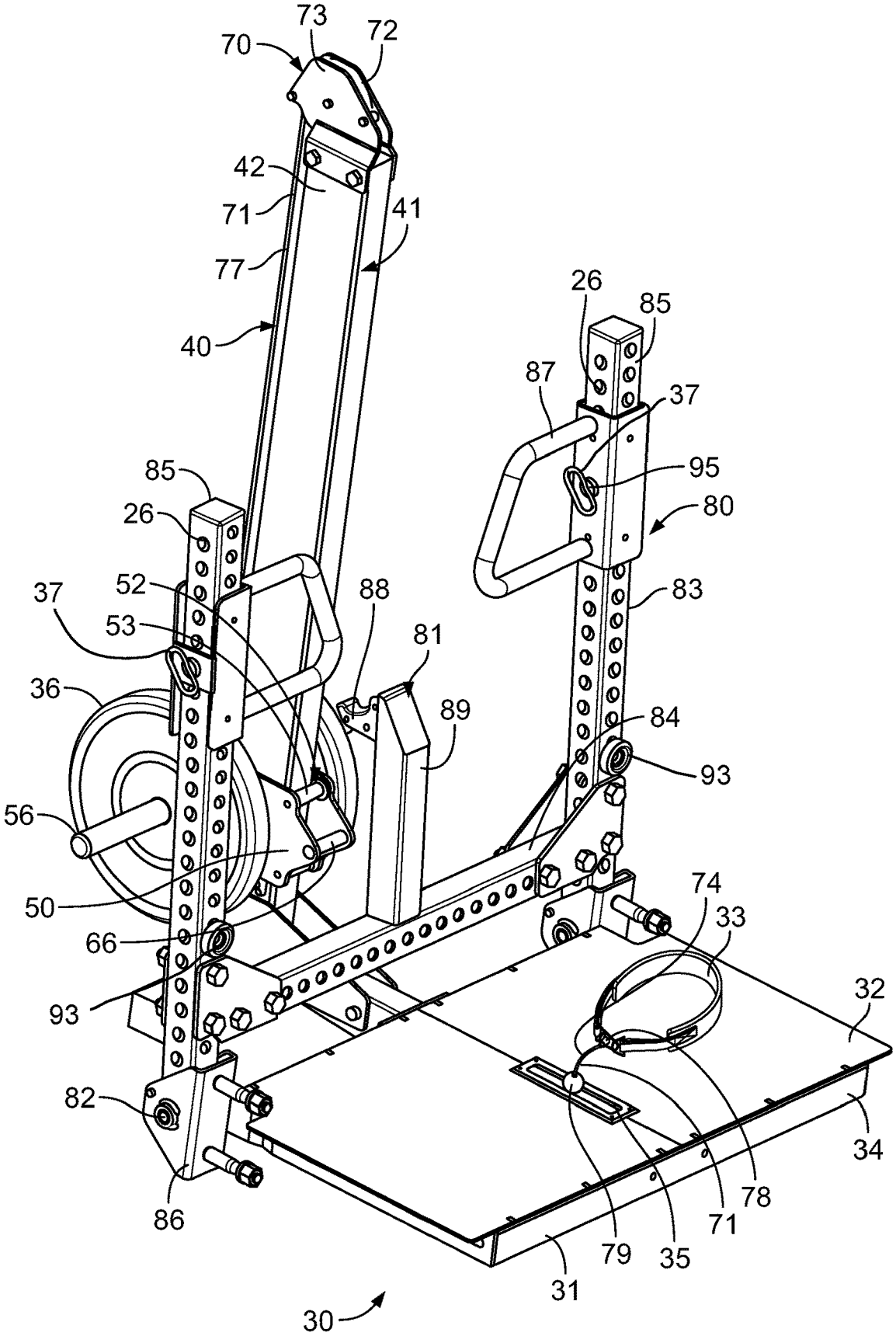
FIG. 2 is a front left perspective view of the weightlifting machine of FIG. 1.
Figure 3:
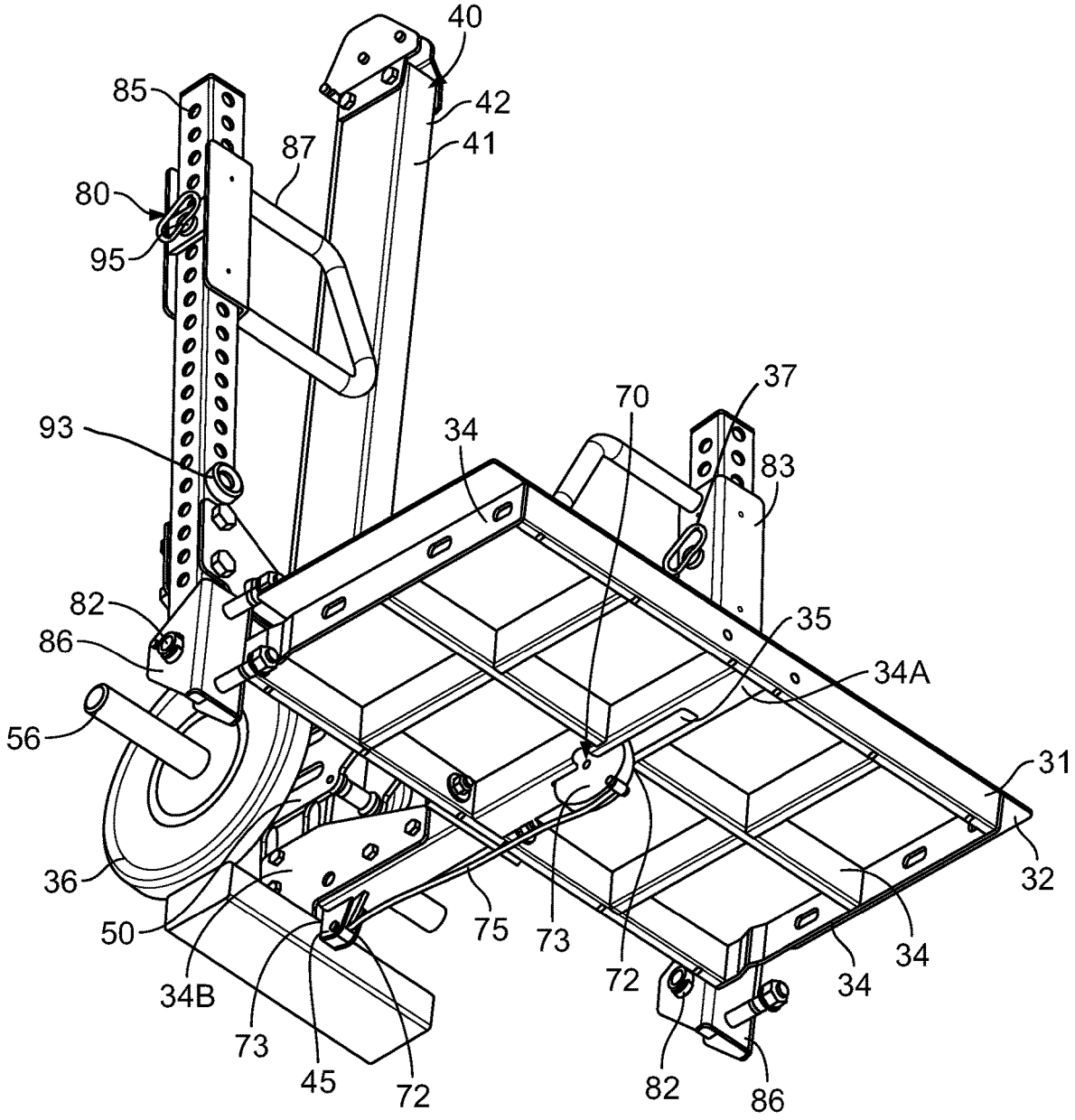
FIG. 3 is a bottom front left perspective view of the weightlifting machine of FIG. 1.
Figure 4:
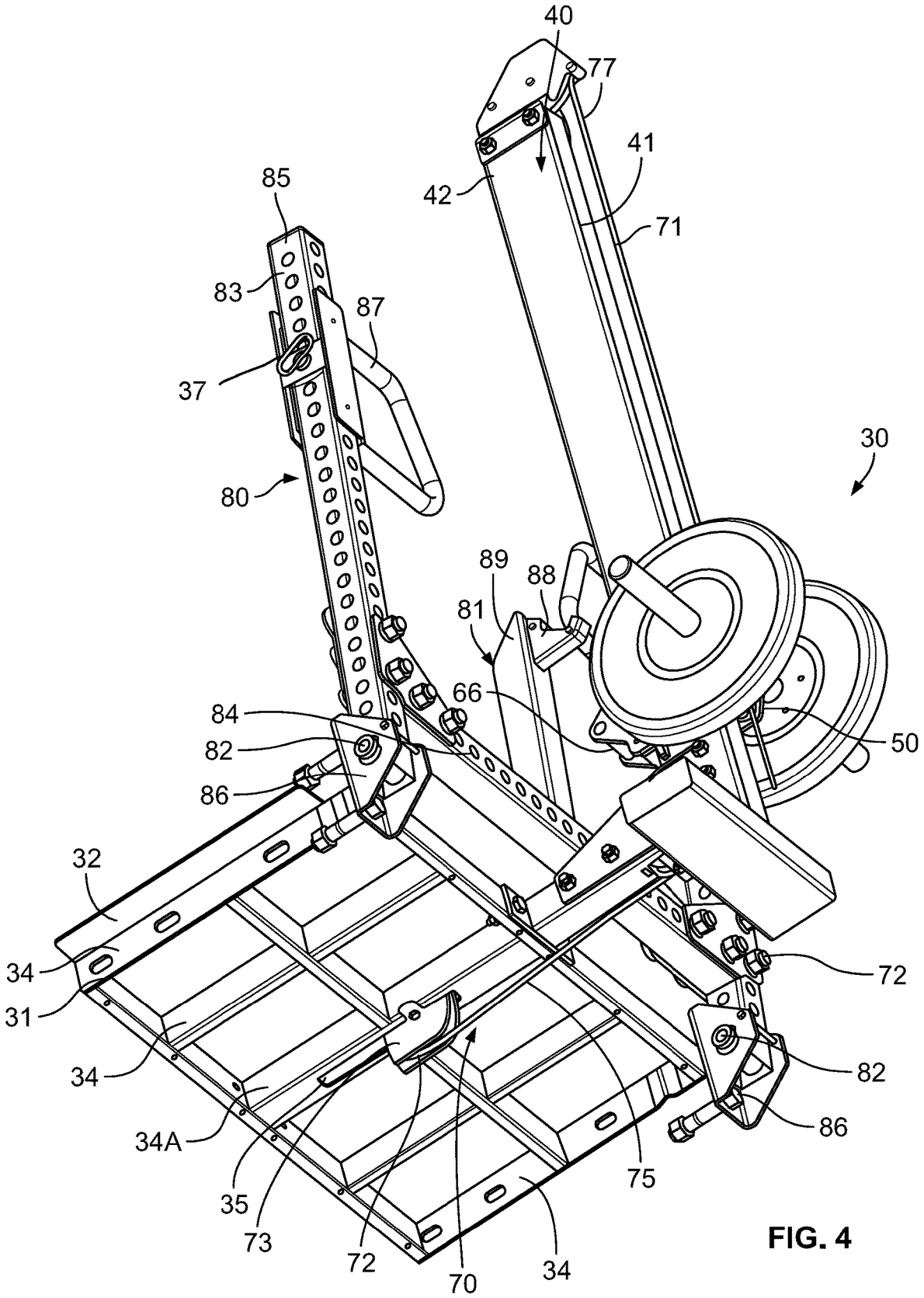
FIG. 4 is a bottom rear right perspective view of the weightlifting machine of FIG. 1.

The platform 32 provides a large, flat, stable surface configured to support the user during operation of the machine 30, such as for a squat lifting exercise or other weightlifting exercise. The platform has a slot 35 approximately along the centerline of the platform 32 to permit a cable 71 of the cable system 70 to extend through the platform from below. The slot 35 extends through the frame member 34A positioned below the centerline of the platform 32 as shown in FIGS. 3-4, to accommodate a pulley 72 and pulley mount 73 that are mounted on the frame member 34A and direct the cable 71 upward through the slot 35. Additionally, the slot 35 is elongated in order to permit the cable 71 to extend through the slot 35 at a wide variety of angles, to permit different forms and user positions, as well as to permit use for exercises other than squats, which may use a non-vertical pulling motion. The platform 32 in FIGS. 1-15 is rectangular, and the left and right edges of the platform 32 overhang the support frame 31 and cover the tops of the adjacent frame members 20 when the machine 30 is connected to the rack assembly 10 as shown in FIGS. 16-17.

The user-engaging device 33 is operably connected to the weight carriage 50 by the cable system 70 as described herein and is configured to engage and/or be engaged by the user in performing a weightlifting exercise on the machine 30. The harness 33 in FIGS. 1-15 is configured to be removably attached to the body of the user. In the embodiment of FIGS. 1-15, the harness 33 is in the form of a belt that wraps around the waist of the user, and which may include fastening structures in order to attach the harness 33 to the user's waist and tighten the harness 33 once connected. Such fastening structures may include buckles, cinches, hook-and-loop connectors, and other such structures. In another embodiment, the harness 33 may include additional structures for attachment to the user, such as shoulder straps and/or chest straps. In further embodiments, the harness 33 may be configured for connection to a different part of the user's body, such as the user's chest, legs, arms, head, etc., and/or the user-engaging device may additionally or alternately include structures such as handles for gripping by the user.

The carriage support 40 in the embodiment of FIGS. 1-15 includes track or guide 41 that extends vertically upward from the support frame 31, such that the weight carriage 50 is mounted on the track 41 and the track 41 guides the movement of the weight carriage 50. The track 41 in this embodiment is formed by a single upright rail 42. In other embodiments, the track 41 may be formed of two or more parallel rails 42 that are engaged with the weight carriage 50. The rail 42 in FIGS. 1-15 is hollow and defines a central passage 42A to permit the cable 71 to extend through the central passage 42A of the rail 42, as shown in greater detail in FIG. 8. The central passage 42A extends at least the majority of the length of the rail 42, and in the embodiment of FIGS. 1-15, the central passage 42A extends substantially the entire length of the rail 42, forming openings at the top and bottom ends of the rail 42. The rail 42 completely encloses the central passage 42A over at least a majority of the length of the rail 42 and surrounds the ascending section 76 of the cable 71 in this embodiment, and in other embodiments, the rail 42 may alternately include an internal slot or groove that permits the cable 71 to extend through the rail 42 while being exposed to the exterior. The position of the ascending section 76 of the cable 71 through the rail 42 helps avoid interference with and/or damage to the cable 71 during use, which permits a more compact form by allowing components to be placed more closely together and more closely to the user without risking contact with the cable 71. Additionally, a pulley 72 of the cable system 70 is mounted at the top of the rail 42 in this embodiment. The rail 42 has a rectangular cross-sectional shape in the embodiment of FIGS. 1-15, with four flat outer surfaces 43 and four corners 44, which is shown in greater detail in FIG. 13.

The weight carriage 50 in the embodiment of FIGS. 1-15 includes a carriage body 51 that is moveably mounted on the track 41 of the carriage support 40 by one or more track-engaging structures 52, with one or more weight mounts 56 connected to the carriage body 51 to support and/or engage removable weights, such as free weights 36 as shown in FIGS. 1-8 or resistance bands 46A. In one embodiment, the track-engaging structure(s) 52 engage opposite surfaces of the track 41, e.g., opposite outer surfaces 43 of the rail 42 in the embodiment of FIGS. 1-15. The track-engaging structure(s) 52 in FIGS. 1-15 include rollers 53 that are positioned to engage front and back outer surfaces 43 of the rail 42 and define a passage 54 through the carriage body 51, such that the track 41 extends through the passage 54 in the carriage body 51. In this configuration, the track 41 and rail 42 thereof are surrounded on all sides by the carriage 50 and are engaged on at least two sides by the carriage 50. In another embodiment, the rollers 53 may be positioned on the left and right sides of the track 41 and may engage the left and right outer surfaces 43 of the rail 42. The carriage 50 in FIGS. 1-15 has four total rollers 53, with two rollers 53 on each side of the passage 54. Each of the rollers 53 has an axle 55 that defines an axis of rotation of the roller 53, and all of the rollers 53 in this embodiment rotate freely on parallel axes. The carriage body 51 includes two plates 57 that are parallel and spaced from each other, and the rollers 53 are connected to the two plates 57 and extend between the two plates 57. The plates 57 define the lateral sides of the passage 54, with the rollers 53 defining the front and rear sides of the passage 54. The rollers 53 provide the sole points of engagement between the carriage 50 and the track 41 in the embodiment of FIGS. 1-15. It is understood that the axles 55 of the rollers 53 extend completely through each roller 53 and between the plates 57 in the embodiment of FIGS. 1-15. In another embodiment, the axle 55 of each roller 53 may be defined by a pair of spindles or other rotary structure on each end of the roller 53.

Figure 13:
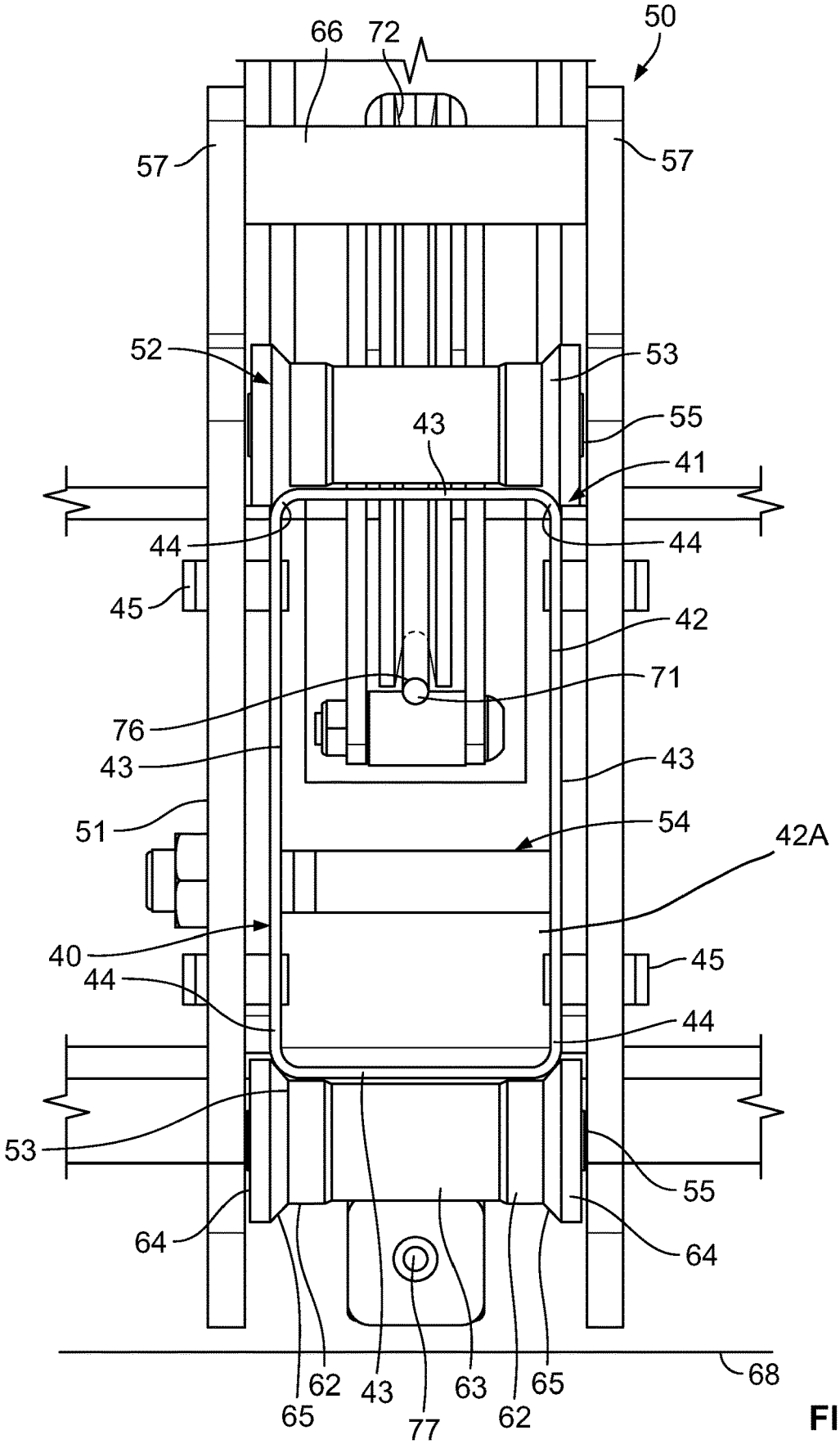
FIG. 13 is a cross-section view taken along lines 13-13 of FIG. 8.
Figure 14:
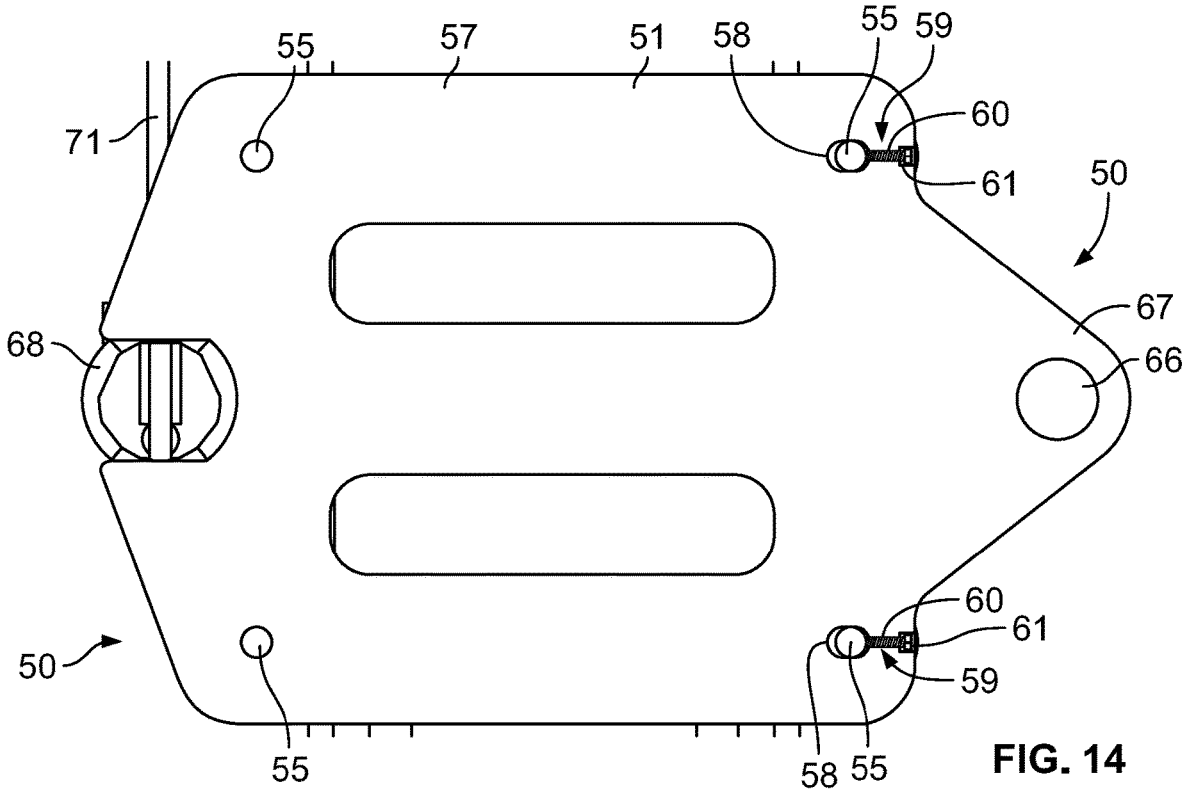
FIG. 14 is a cross-section view taken along lines 14-14 of FIG. 8.
Figure 15:
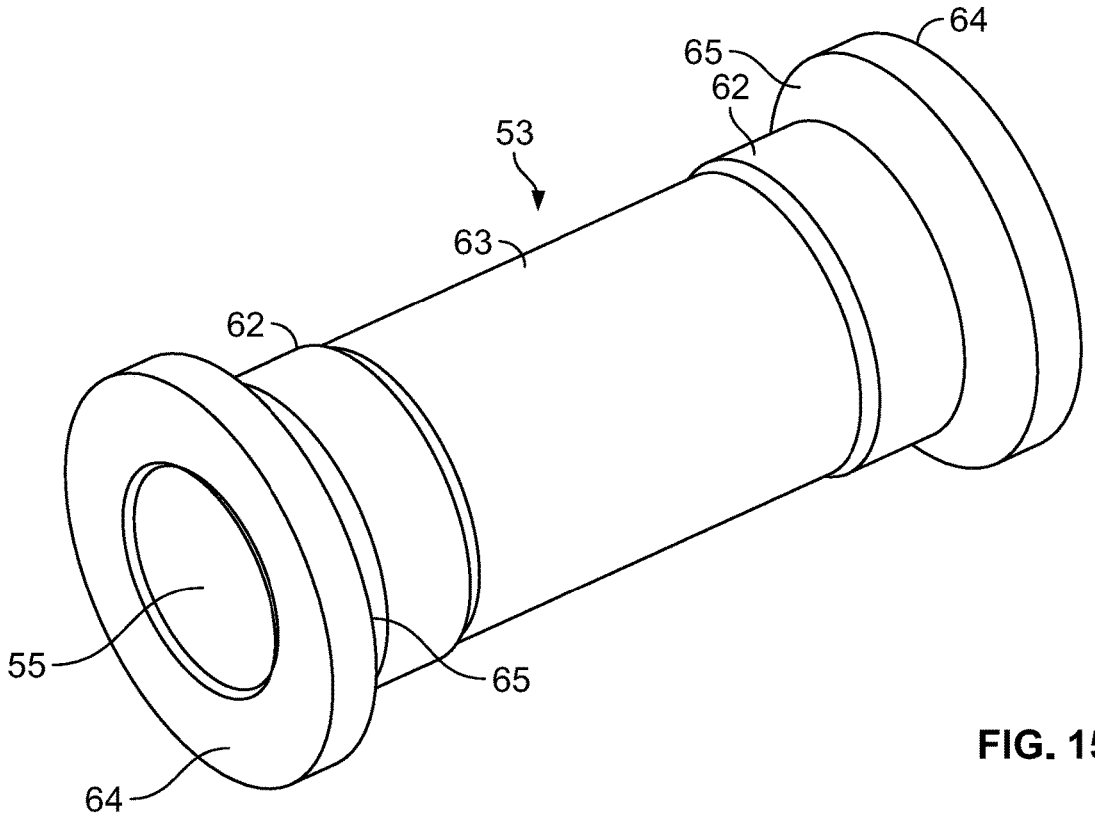
FIG. 15 is a perspective view of a roller of the weight carriage of FIG. 12.

The carriage 50 also has an adjustment mechanism to adjust the spacing S between the axles 55 of the front rollers 53 and the rear rollers 53, as shown in FIGS. 14-15. In this embodiment, the axles 55 of the rear rollers 53 are laterally/horizontally fixed, and the axles 55 of the front rollers 53 are adjustable closer or farther from the rear rollers 53 to increase or decrease the spacing S. In the embodiment of FIGS. 1-15, the adjustment mechanism for adjusting the spacing S includes slots 58 that receive the ends of the axles 55 and have a length that is elongated in the front-to-rear direction. The axles 55 can be moved forward and rearward within the slots 58 to adjust the spacing S between the axles 55 of the front and rear rollers 53. The carriage 50 further includes fixing members 59 in this embodiment for fixing and/or adjusting the positions of the axles 55 within the slots 58. In one embodiment, shown in FIGS. 12 and 14, the fixing members 59 are formed by set screws 60 that are received in threaded apertures 61 that transversely intersect the slots 58. The positions of the axles 55 within the slots 58 in this embodiment can be incrementally adjusted forward or rearward by advancing or retreating the set screws 60 within the apertures 61, such that the ends of the screws 60 push the axles 55 rearwardly or provide space for the axles 55 to move forwardly, respectively. Each of the four slots 58 has a separate fixing member 59 for moving and fixing the corresponding axle 55 within the slot 58. Generally, the set screws 60 are advanced within the apertures 61 to push the axles 55 until the front rollers 53 engage the rail 42 tightly, allowing the carriage 50 to accommodate different tracks 41 having different front-to-rear dimensions.

The rollers 53 in the embodiment of FIGS. 1-15 and the engagement of the rollers 53 with the track 41 are illustrated in greater detail in FIGS. 13 and 15. In this embodiment, each roller 53 has a cylindrical body with a first section 62 having a larger cylindrical diameter and a second section 63 having a relatively smaller cylindrical diameter than the first section 62. In this configuration, the first section 62 engages the rail 42 and the second section 63 is spaced from the rail 42 due to the smaller diameter of the second section 63. The rollers 53 in FIGS. 13 and 15 each have two first sections 62 located near the ends of the roller 53 and a second section 63 located at the center of the roller 53 between the two first sections 62. The change in diameter between the first sections 62 and the second section 63 in this embodiment is a tapered or chamfered diameter change, but may be a step-change in another embodiment. Additionally, the rollers 53 in FIGS. 13 and 15 have enlarged ends 64 with chamfered or conical sections 65 having gradually decreasing diameters and extending between the ends 64 and the first sections 62. The rollers 53 having this configuration engage the rail 42 by the first sections 62 engaging the front and rear outer surfaces 43 of the rail 42 and the first sections 62 and the chamfered sections 65 combining to engage the corners 44 of the rail 42, as shown in FIG. 13.

In another embodiment, the rollers 53 may engage the track 41 in another manner. In a further embodiment, the weight carriage 50 may include track-engaging structures 52 that engage the track 41 in a different manner, and the track 41 may include complementary structures for such engagement. For example, the track 41 may include rails, flanges, grooves, lips, or other structures that are engaged by track-engaging structures 52 of the carriage 50, such as rollers, wheels, clamps, etc.

The carriage 50 in the embodiment of FIGS. 1-15 is configured to move by translation up and down along the track 41, and the rollers 53 roll against the outer surfaces 43 of the rail 42 during this movement. The track 41 has stops 45 near the bottom of the rail 42 that prevent further downward movement of the carriage 50. Additionally, the carriage 50 has an engagement member 66 at the front of the carriage 50 that is engaged by the locking mechanism 80 to hold the carriage 50 in an elevated position. The engagement member 66 in the embodiment of FIGS. 1-15 is a bar or peg that extends between the plates 57 at the front of the carriage 50. The carriage 50 in this embodiment further includes projections 67 on the plates 57 extending outward from the front of the carriage 50, and the engagement member 66 extends between the projections 67 to position the engagement member 66 forward of the track 41. The engagement between the engagement member 66 and the locking mechanism 80 is described in greater detail elsewhere herein. The carriage 50 in this embodiment has a single beam 68 engaged with recesses 69 in both plates 57 of the carriage body 51 that forms two weight mounts 56 extending laterally outward on left and right lateral sides of the carriage body 51, each of which is configured to support barbells or other free weights 36. In other embodiments 50, the carriage 50 may have one or more weight mounts 56 having a different configuration. The carriage 50 and the weight or weights (e.g., free weights 36 and/or resistance bands 46A) engaged therewith may be considered to form a moveable weight assembly to provide resistance for a weightlifting exercise.

The cable system 70 and the cable 71 thereof operably connect the harness 33 with the carriage 50 so that the harness 33 and the carriage 50 move in unison and the weight of the carriage 50 exerts a tension force on the harness 33 to offer resistance to pulling force on the harness 33. The cable system 70 includes a cable 71 connected at one end to the harness 33 and at the other end to the carriage 50, and a series of pulleys 72 that direct and/or guide the path of the cable 71 between the harness 33 and the carriage 50. The cable 71 may include multiple cable pieces that are connected together to function as a single cable, or a single, integral cable piece. Each pulley 72 is rotatably mounted on the machine 30 by a pulley mount 73, including two pulleys 72 and mounts 73 that are mounted to the bottom of the support frame 31 and another pulley 72 and mount 73 that are mounted at the top of the carriage support 40. The cable 71 in this configuration has a user-engaging device or harness cable section 74 that extends downward from the harness 33 through the slot 35 in the platform 32 to a first pulley 72 below the slot 35, which redirects the cable 71 in a front-to-rear direction to form a lateral cable section 75 that extends to a second pulley 72 at the base of the carriage support 40. The second pulley 72 redirects the cable 71 upward to form an ascending cable section 76 (FIGS. 9 and 13) that extends to the top of the carriage support 40 to a third pulley 72, which redirects the cable 71 approximately 180° to form a descending cable section 77 that is connected to the carriage 50. It is understood that the various cable sections 74, 75, 76, 77 described herein are sections of cable routing, and not necessarily discrete sections of the cable 71 itself, as a specific portion of the cable 71 may move between sections through movement of the harness 33 and the carriage 50.

Figure 5:
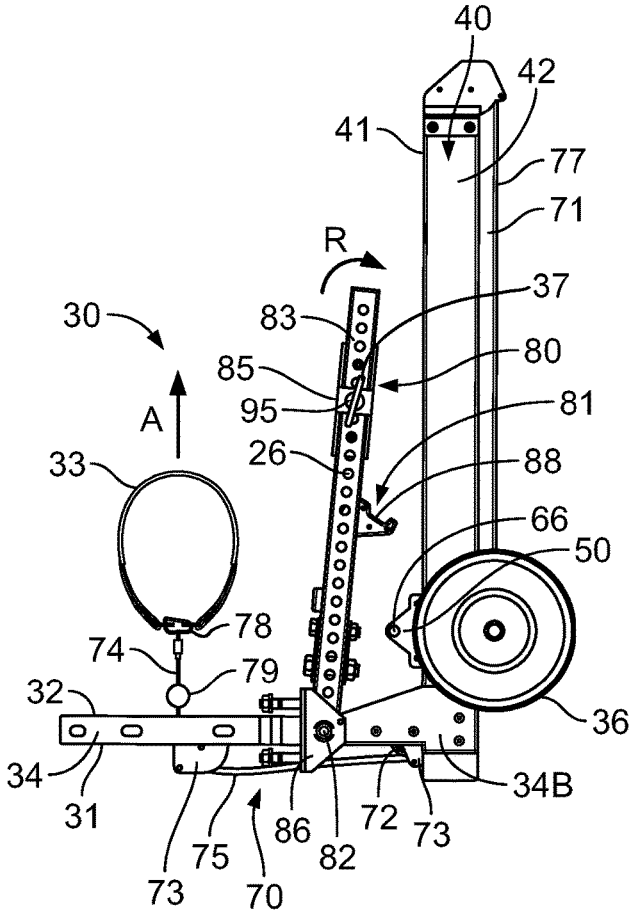
FIG. 5 is a right side view of the weightlifting machine of FIG. 1 with a weight carriage of the machine located in a lowermost position and a locking mechanism of the machine located in a release position.
Figure 6:
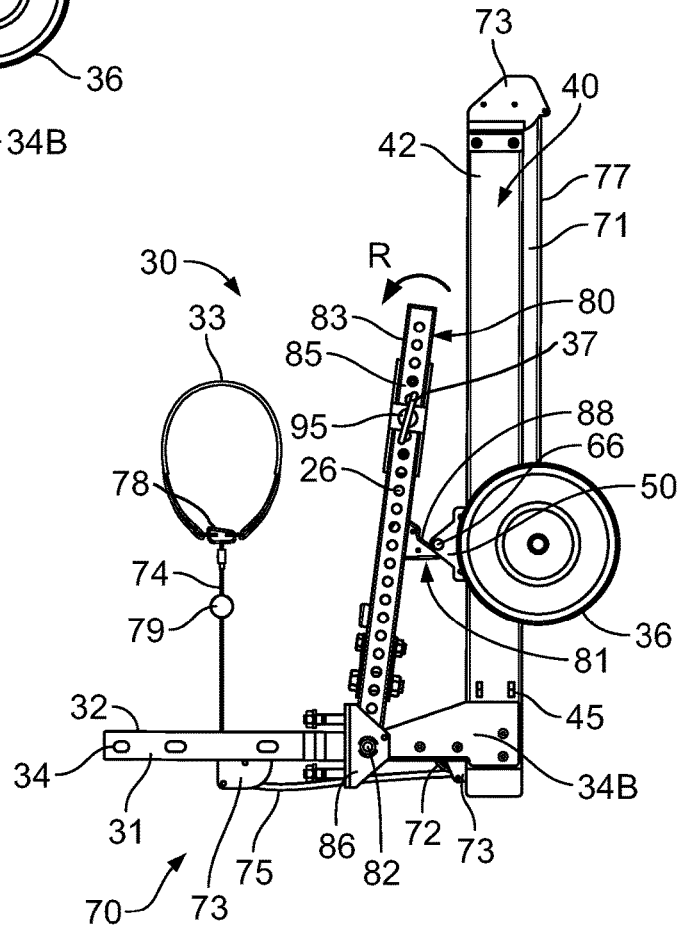
FIG. 6 is a right side view of the weightlifting machine of FIG. 1 with the weight carriage of the machine located in an elevated position and the locking mechanism of the machine located in a locking position and supporting the weight carriage.

The carriage 50 may have a cable connection structure that is configured for connection to the cable 71, and the cable connection structure may be positioned at the rear of the carriage 50 in one embodiment. The cable 71 is connected to the carriage 50 by connection to the beam 68 forming the weight mounts 56 in the embodiment illustrated in FIGS. 9-14, but may be connected to the carriage 50 in a different manner in other embodiments. The harness cable section 74 may be connected to the harness 33 by a removable connecting structure such as a karabiner clip 78 or other such structure, as shown in FIGS. 2, 5, and 6, which can enable removal and interchanging of harnesses 33 and/or connection of an additional length of cable 71 in order to provide a greater cable length. The harness cable section 74 may further include a stopper 79 such as a rubber ball that is wider in diameter than the width of the slot 35, which is connected to the cable 71 to prevent the cable 71 from being pulled farther into the slot 35 and to ensure that some length of the cable 71 will extend out of the slot 35, as also shown in FIGS. 2, 5, and 6. The pulleys 72 in the embodiment of FIGS. 1-15 are not configured to create a mechanical advantage between the harness 33 and the carriage 50, but in another embodiment, the cable system 70 may be configured to create a mechanical advantage. In a further embodiment, the cable system 70 may include multiple cables 71 that may not be contiguous, such as by using a gear system to transfer energy from a first cable 71 to a second cable 71.

Figure 7:
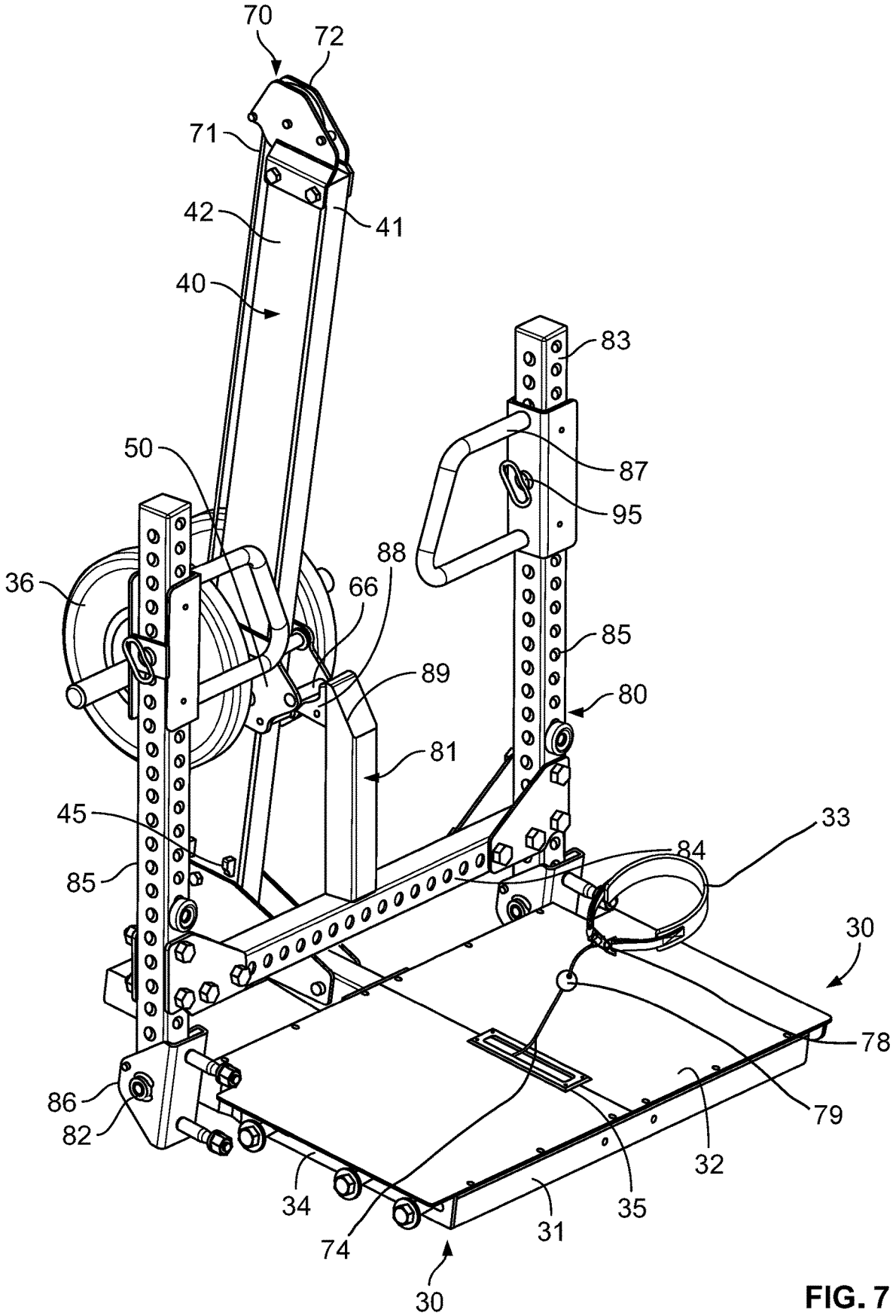
FIG. 7 is a front left perspective view of the weightlifting machine of FIG. 6.
Figure 8:
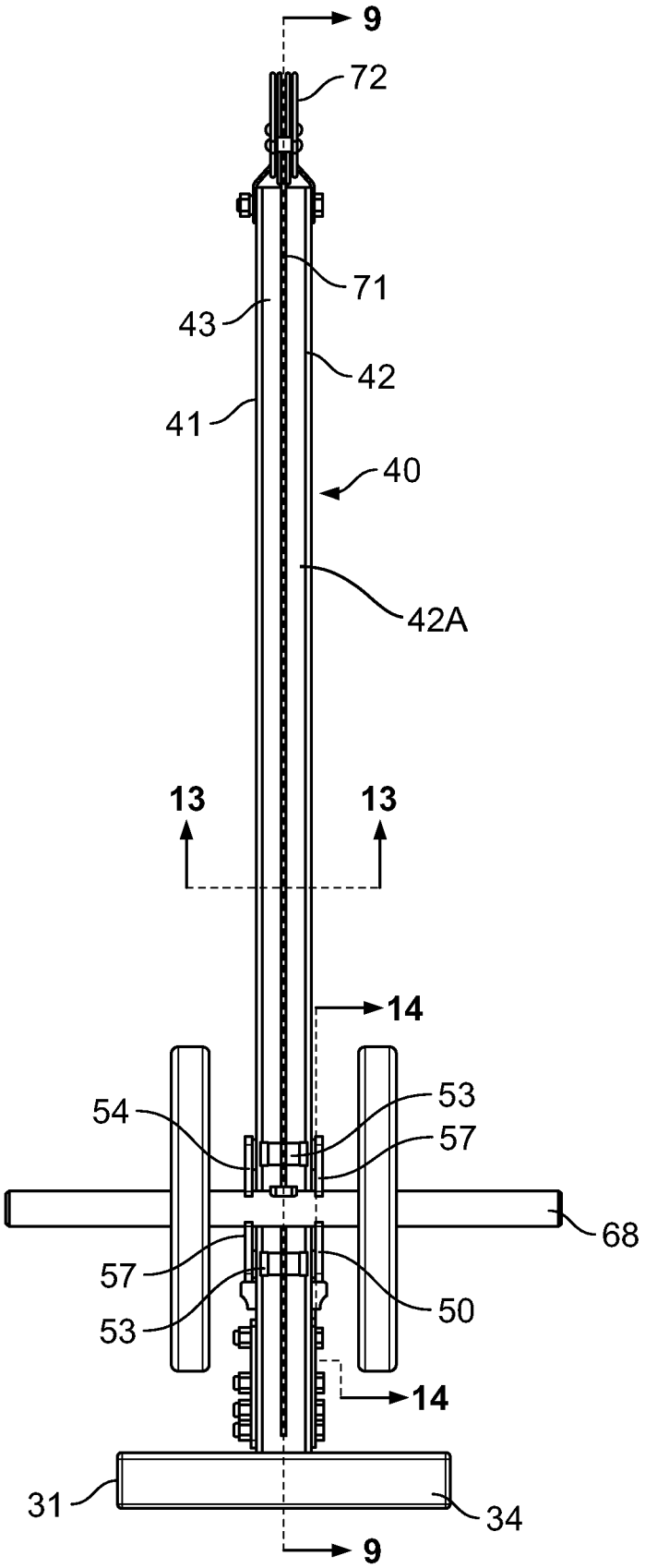
FIG. 8 is a rear view of a portion of the weightlifting machine of FIG. 1.
Figure 9:
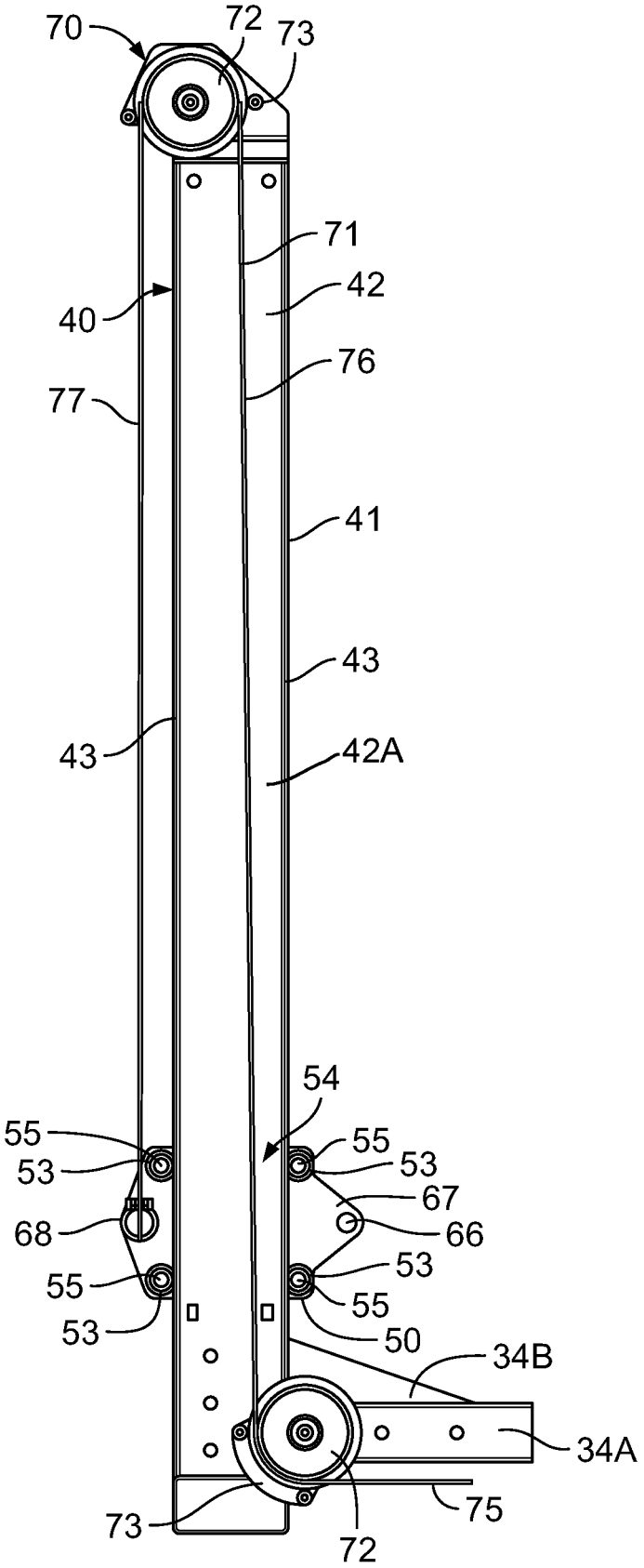
FIG. 9 is a cross-section view taken along lines 9-9 of FIG. 8.
Figure 10:
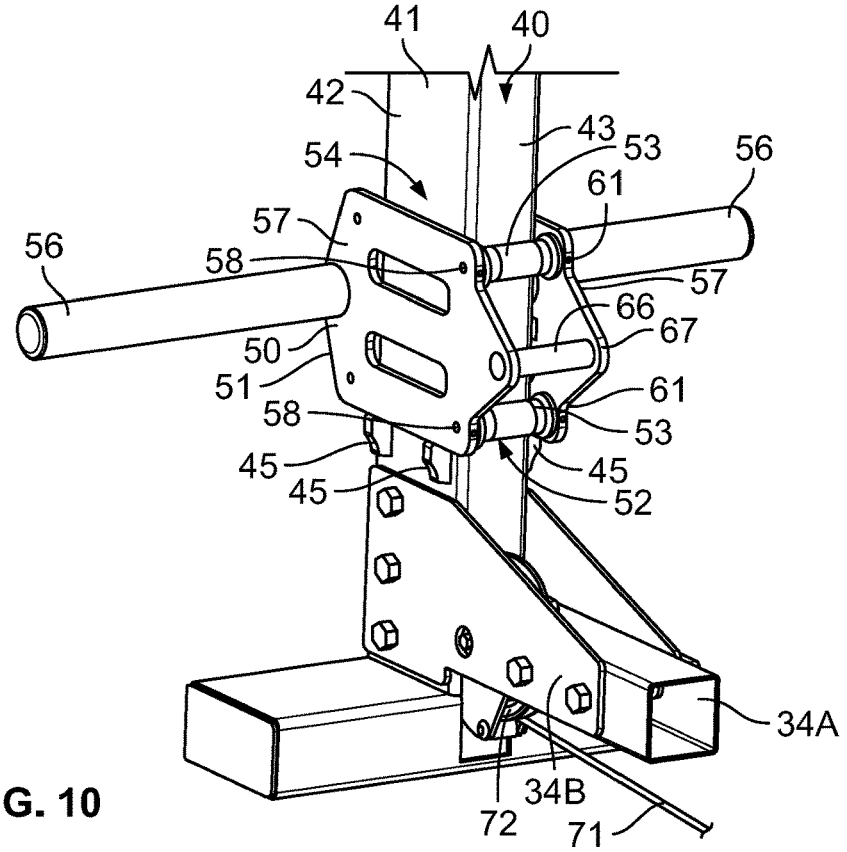
FIG. 10 is a front left perspective view of a portion of the weightlifting machine of FIG. 1.
Figure 11:
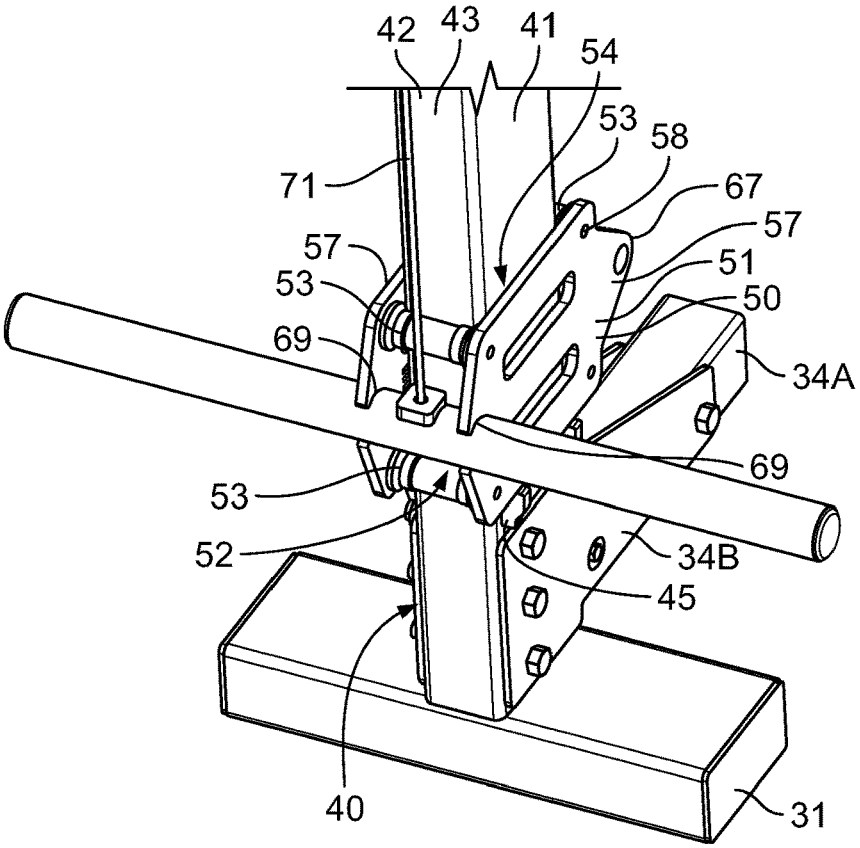
FIG. 11 is a rear left perspective view of a portion of the weightlifting machine of FIG. 1.
Figure 12:
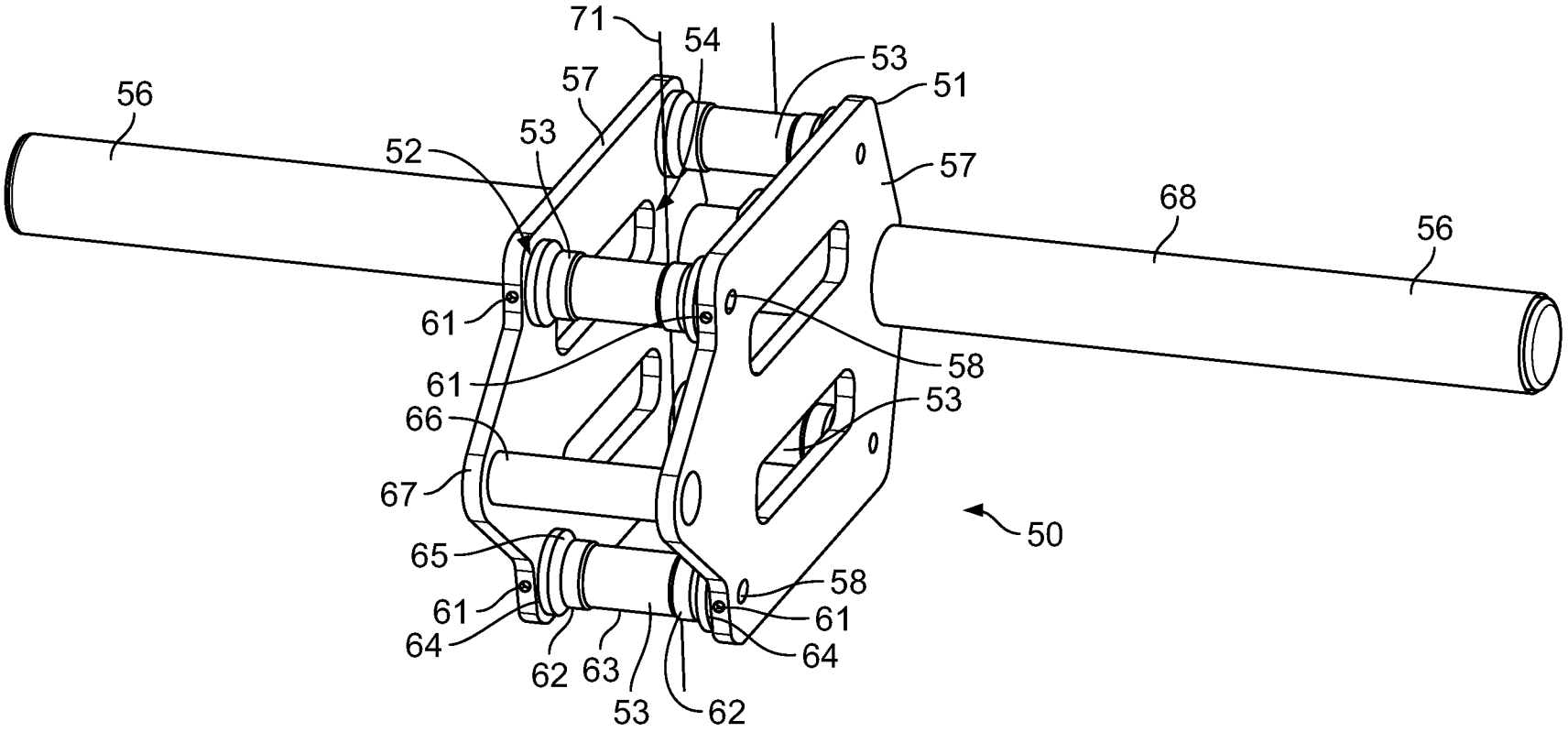
FIG. 12 is a front left perspective view of the weight carriage of the weightlifting machine of FIG. 1.

The machine 30 in FIGS. 1-15 has a locking mechanism 80 that is configured to selectively support the carriage 50 at an elevated position located above the lowermost position of the carriage 50 along the track 41. FIGS. 1-5 illustrate the carriage 50 in the lowermost position on the track 41, which is defined by the stops 45, and FIGS. 6-7 illustrate the locking mechanism 80 supporting the carriage 50 at the elevated position. Lifting the carriage 50 to the elevated position allows the harness 33 to be extended a greater distance upward from the platform 32, so that exercise can be started and finished in a more safe, proper, and comfortable position, and also facilitates adding and removal of weights 36 from the weight mounts 56. The locking mechanism 80 in FIGS. 1-15 includes a locking member 81 that is moveable between a locking position where the locking member 81 engages and supports the carriage 50 in the elevated position (see FIGS. 6-7) and a release position (see FIGS. 1-5), where the locking member 81 does not engage the carriage 50 or obstruct movement of the carriage 50, and the carriage 50 is free to move below the elevated position to a lowermost position of the carriage 50. The locking member 81 moves by pivoting about a pivot point 82 in one embodiment, as illustrated in FIGS. 5-6, where the locking member 81 is shown pivoting about the pivot point 82 as indicated by rotational arrows R. The locking mechanism 80 may further include structures to assist in moving the locking member 81 between the locking position and the release position.

The locking mechanism 80 in FIGS. 1-15 further includes a pivoting body 83 pivotably connected to one or more brackets or other pivot connections 86 that define(s) the pivot point 82, and the locking member 81 is fixedly connected to the pivoting body 83 and pivots with the pivoting body 83 about the pivot point 82. As shown in FIGS. 1-7, the pivoting body 83 includes a base or base member 84 with one or more vertical members 85 connected to the base 84, with the or each vertical member 85 having a handle 87 configured for gripping by a user to pivot the pivoting body 83. In the embodiment of FIGS. 1-7, the pivoting body 83 has two vertical members 85 that are spaced from each other along the horizontal length of the base 84, each having a handle 87, and the base 84 extends horizontally between the vertical members 85. The locking member 81 in this embodiment is connected to the base 84 and extends upward from the base 84 at a position located between the vertical members 85 along the horizontal length of the base 84, and may be equidistant from the two vertical members 85 to form a W-shape or E-shape as shown in FIGS. 1-4. The vertical members 85 also extend downward from the base 84 in the embodiment of FIGS. 1-7 to connect to two pivot connections 86 on the support frame 31. In this configuration, the pivot connections 86 and the pivot point 82 defined thereby are positioned below the base 84, and the locking member 81 is positioned above the base 84. The handles 87 provide multiple surfaces for gripping in various different heights, orientations, and grip angles, to provide versatility according to user requirements and preferences. The handles 87 may also be adjustable in position along the length of the vertical members 85, such as by use of a removable and/or adjustable fixing structure that may engage fastener holes 26 in the vertical members 85. For example, in the embodiment of FIGS. 1-15, the handles 87 have apertures 95 that are configured to receive a pin 37, e.g., a cotter pin or other locking pin, that extends through the fastener holes 26 in the vertical members 85 to fix the handles 87 in position adjustably. In other embodiments, a different structure may be used, such as a spring pin or other non-removable structure. In other embodiments, the pivoting body 83 may be differently configured, such as by having one or more vertical members 85 that are positioned or configured differently, having one or more vertical members 85 directly connected to the locking member 81 (e.g., with no base 84), having handles 87 that are differently configured, and/or having a separate structure other than the vertical member(s) 85 connected to the pivot connection(s) 86.

Figure 18:
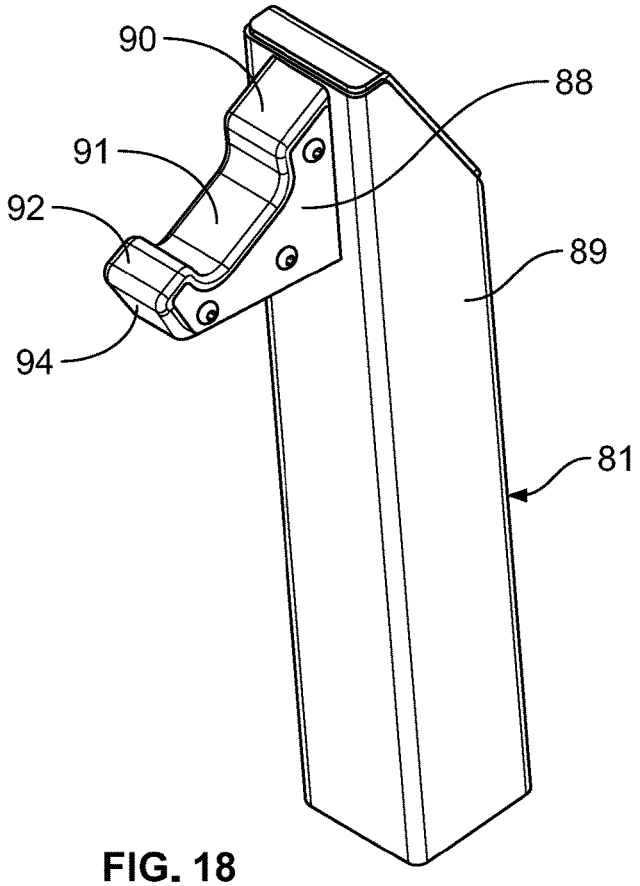
FIG. 18 is a front left perspective view of a locking member of the weightlifting machine of FIG. 1.
Figure 19:
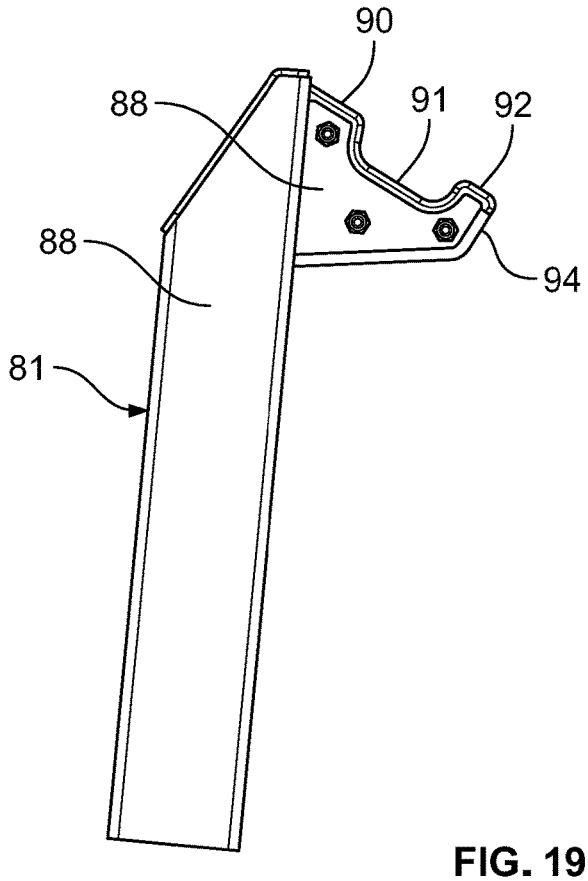
FIG. 19 is a right side view of the locking member of FIG. 18.

The locking member 81 in FIGS. 1-7 is shown in greater detail in FIGS. 18-19 and includes an engagement part 88 that is configured to engage the carriage 50 and an arm 89 that is connected to the pivot body 83 and extends from the pivot body 83, such that the engagement part 88 is connected to the arm 89 and spaced from the pivot body 83. The engagement part 88 is connected at or near the distal end of the arm 89 in the embodiment of FIGS. 1-7 and 18-19, and the arm 89 is in the form of a rectangular post with a chamfered or beveled end. The engagement part 88 in this embodiment extends outwardly from the arm 89 and has a sloped top surface 90 that has a notch 91 and a protrusion 92 at the distal end of the engagement part 88. When the engagement part 88 engages the carriage 50 to lock and support the carriage 50 in the elevated position, the engagement member 66 of the carriage 50 is received in the notch 91 and engages the protrusion 92 to retain the carriage 50 in engagement with the engagement part 88. In the embodiment of FIGS. 1-7, the engagement member 66 of the carriage 50 is a round bar or peg as described above, and the engagement part 88 extends between the plates 57 of the carriage 50 to engage the engagement member 66. The distal end of the engagement part 88 also has a beveled or chamfered surface 94 below the protrusion 92, which can be engaged by the engagement member 66 of the carriage 50 to push the locking mechanism 80 toward the release position and allow the carriage 50 to pass, if the carriage 50 is raised from below the engagement part 88 when the locking mechanism 80 is in the locking position. It is understood that the engagement part 88 and the engagement member 66 of the carriage 50 may have different structures, and these parts may have complementary structures that are configured for engagement with each other. The engagement part 88 in one embodiment may have a structure as shown and described in U.S. patent application Ser. No. 16/275,027, filed on Feb. 13, 2019, which is incorporated by reference herein.

Figure 24:
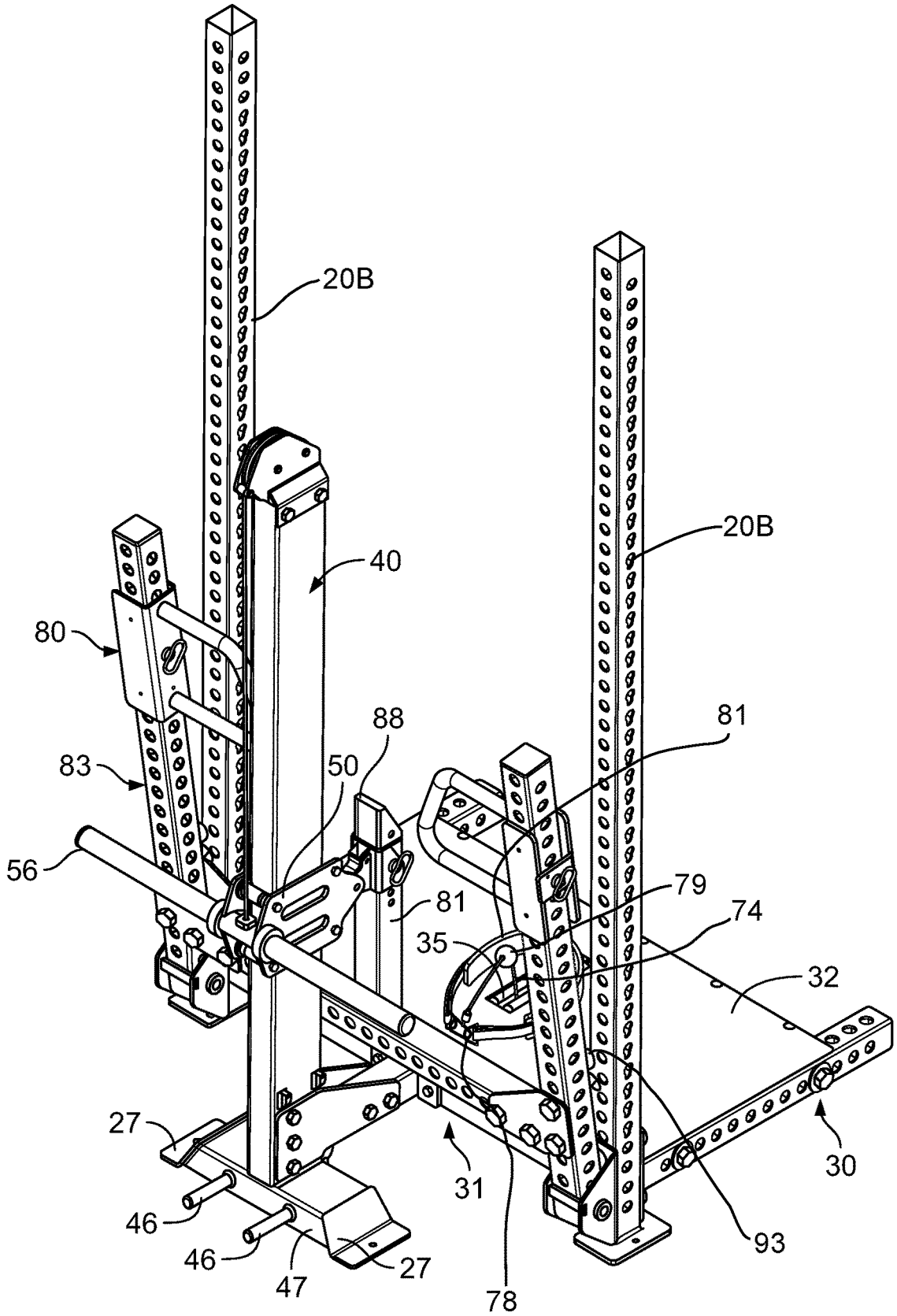
FIG. 24 is a rear left perspective view of the weightlifting machine of FIG. 23 with a weight carriage of the machine located in an elevated position and a locking mechanism of the machine located in a locking position and supporting the weight carriage.
Figure 25:
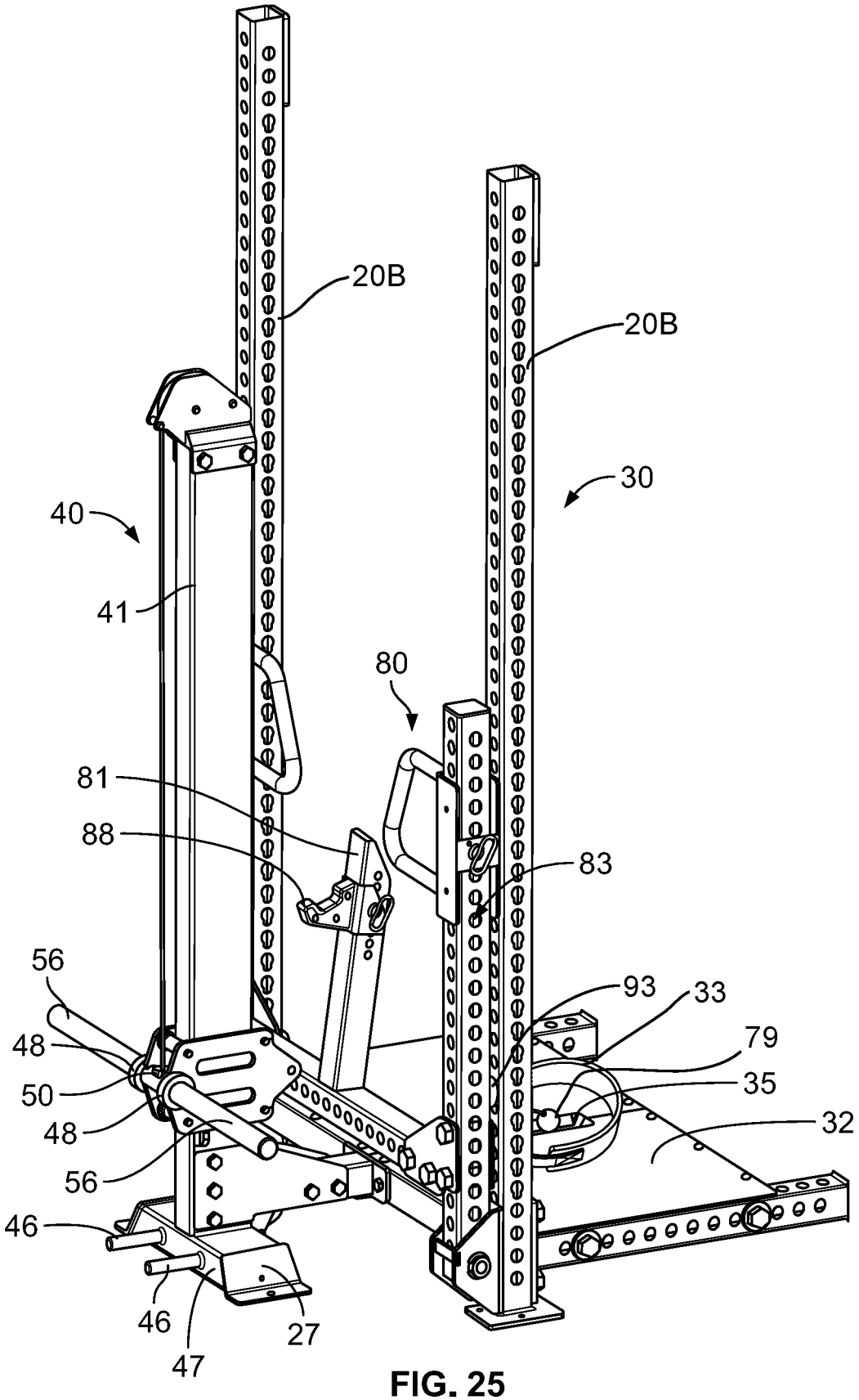
FIG. 25 is a rear left perspective view of the weightlifting machine of FIG. 23 with the weight carriage of the machine located in a lowermost position and the locking mechanism of the machine located in a release position.
Figure 26:
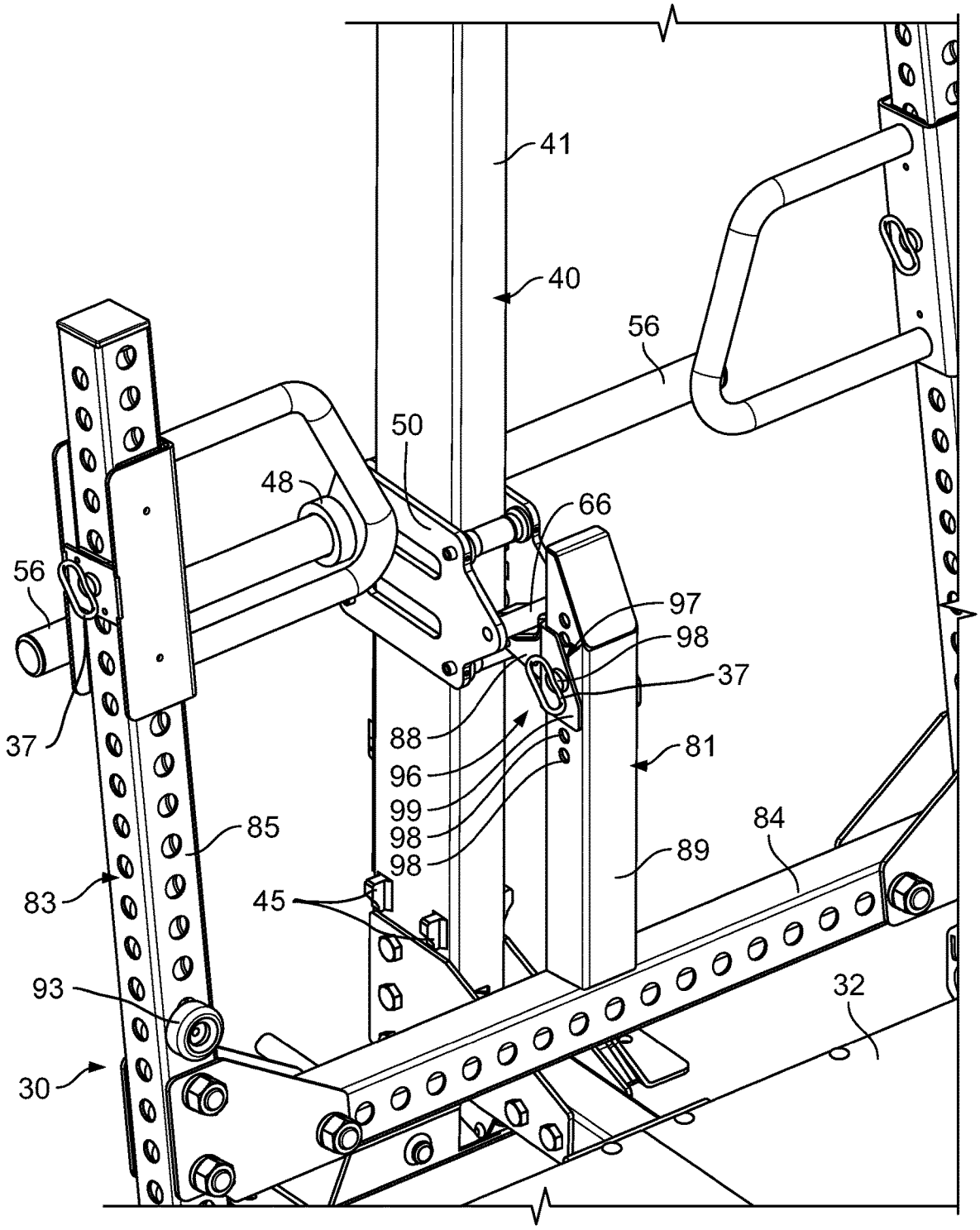
FIG. 26 is a front left perspective view of a portion of the weightlifting machine of FIG. 24.
Figure 27:
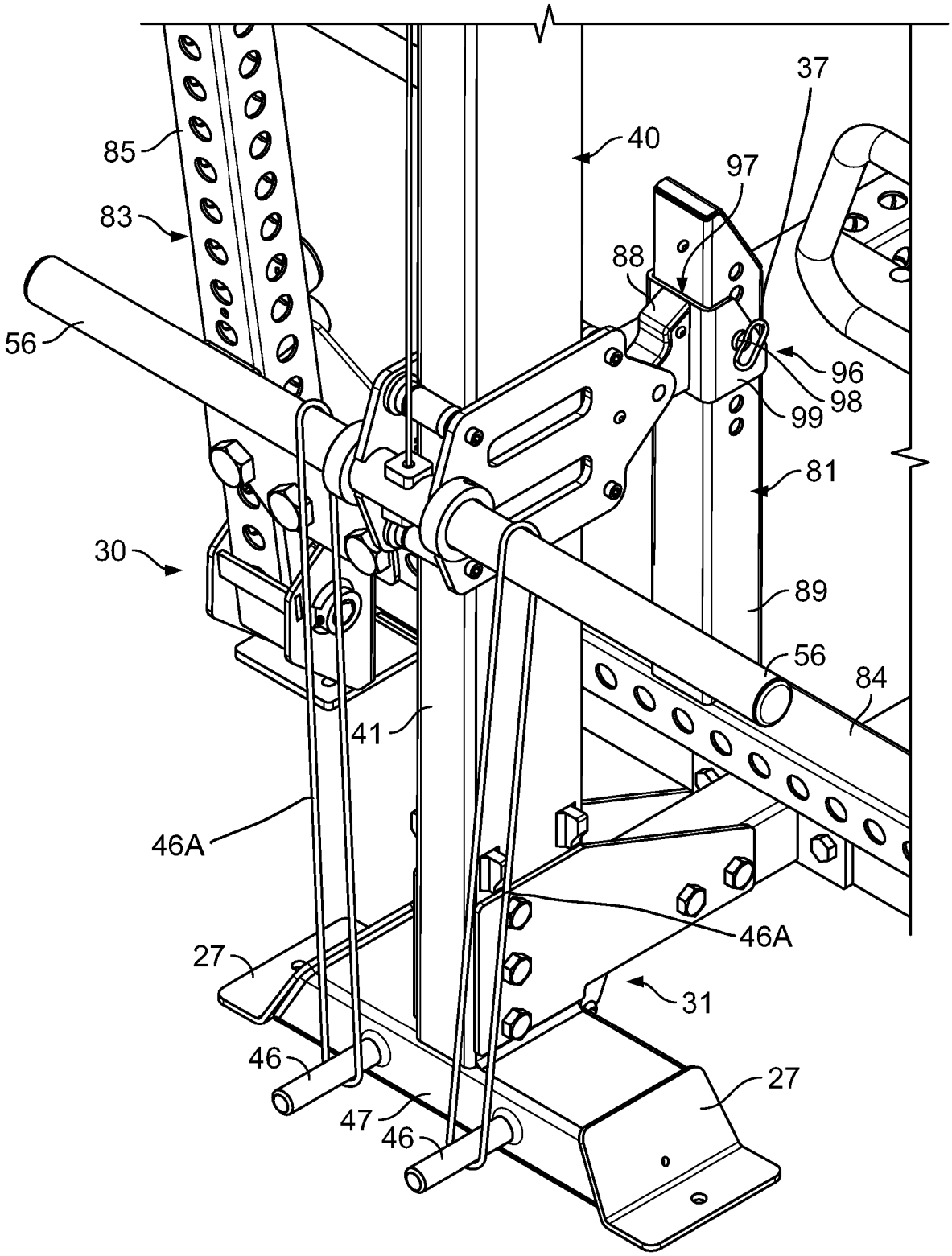
FIG. 27 is a rear left perspective view of a portion of the weightlifting machine of FIG. 24.
Figure 28:
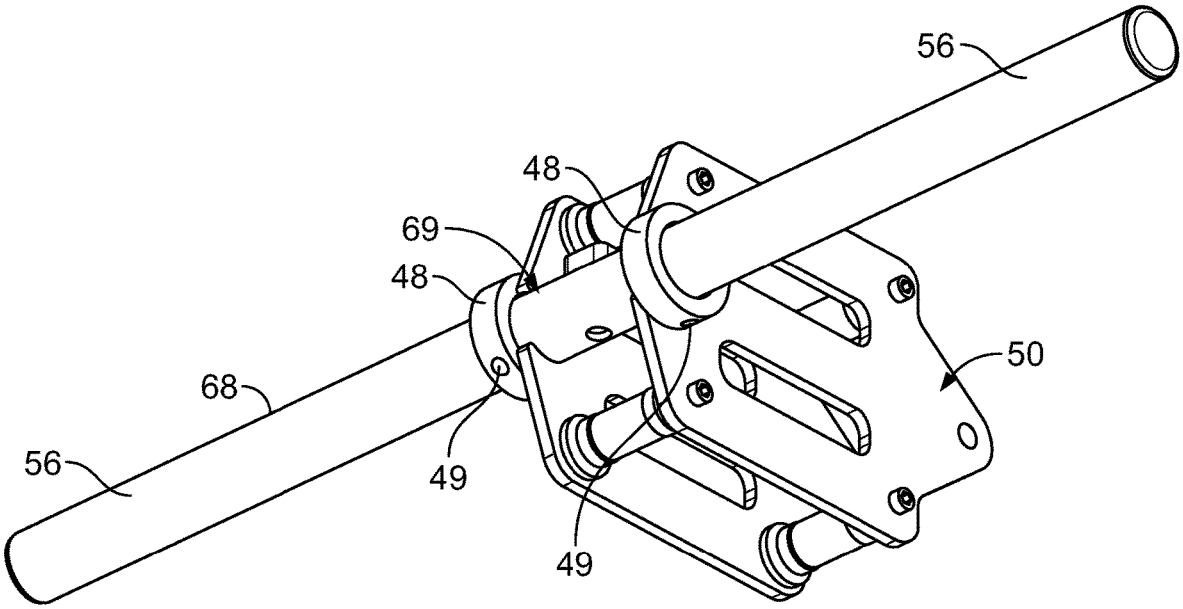
FIG. 28 is a bottom rear left perspective view of the weight carriage of the weightlifting machine of FIG. 23.

The locking mechanism 80 may have motion limiting structures configured to limit the range of motion of the locking mechanism 80 away from the locking position and/or away from the release position. The pivot connections 86 in one embodiment have stops 93 configured to limit the degree of rearward/downward pivoting of the pivot body 83 and the locking member 81, i.e., to limit motion of the locking mechanism 80 away from the release position. Additionally, in one embodiment, the pivot connections 86 are connected (e.g., fixedly mounted) to vertical frame members of the supporting assembly 11, such as vertical frame members 20B of the weight rack 10 to which the machine 30 is connected (see FIGS. 16-17 and 24-25) or vertical frame members 21A of the support frame 31 configured to be a stand-alone structure (see FIG. 33). In this configuration, the vertical frame members (e.g., 20B or 21A) limit the degree of forward pivoting of the pivot body 83 by the pivot body 83 and/or the vertical members 85 thereof abutting the vertical frame members (e.g., 20B or 21A), i.e., limiting motion of the locking mechanism 80 away from the locking position. It is understood that the vertical frame members may include pads or other abutting structures for this purpose. FIGS. 24 and 25 illustrate the range of motion of the locking mechanism 80 permitted by these motion limiting structures in one embodiment.

In operation, the carriage 50 is placed in the elevated position, and the locking mechanism 80 is placed in the locking position to lock and support the carriage 50 in the elevated position. The carriage 50 may be loaded with weights before or after being locked in the elevated position. The user then engages the user-engaging device, e.g., by fastening the harness 33 to his/her body, and exerts tension force on the cable 71 (e.g., by exerting upward force on the harness 33) to raise the carriage 50 to a height sufficient to clear the protrusion of the engagement part 88. At that point, the user can grip the handles 87 to move the pivot body 83 and the locking member 81 to the release position, allowing the carriage 50 to move freely along the track 41 without interference from the locking mechanism 80. When the user has finished the exercise, the carriage 50 can be raised at or above the elevated position, and the locking mechanism 80 can be moved to the locking position to permit the engagement part 88 to engage and support the carriage 50 in the elevated position. In one embodiment, the locking mechanism 80 may be biased toward the locking or release position, such as by use of springs, counterweighting, or other biasing structures. For example, the locking mechanism 80 may be biased toward the release position, allowing the locking mechanism to be moved to the release position simply by lifting the carriage to clear the protrusion 92 of the engagement part 88, and requiring the user to push on the pivot body 83 to return the locking mechanism 80 to the locking position.

Figure 20:
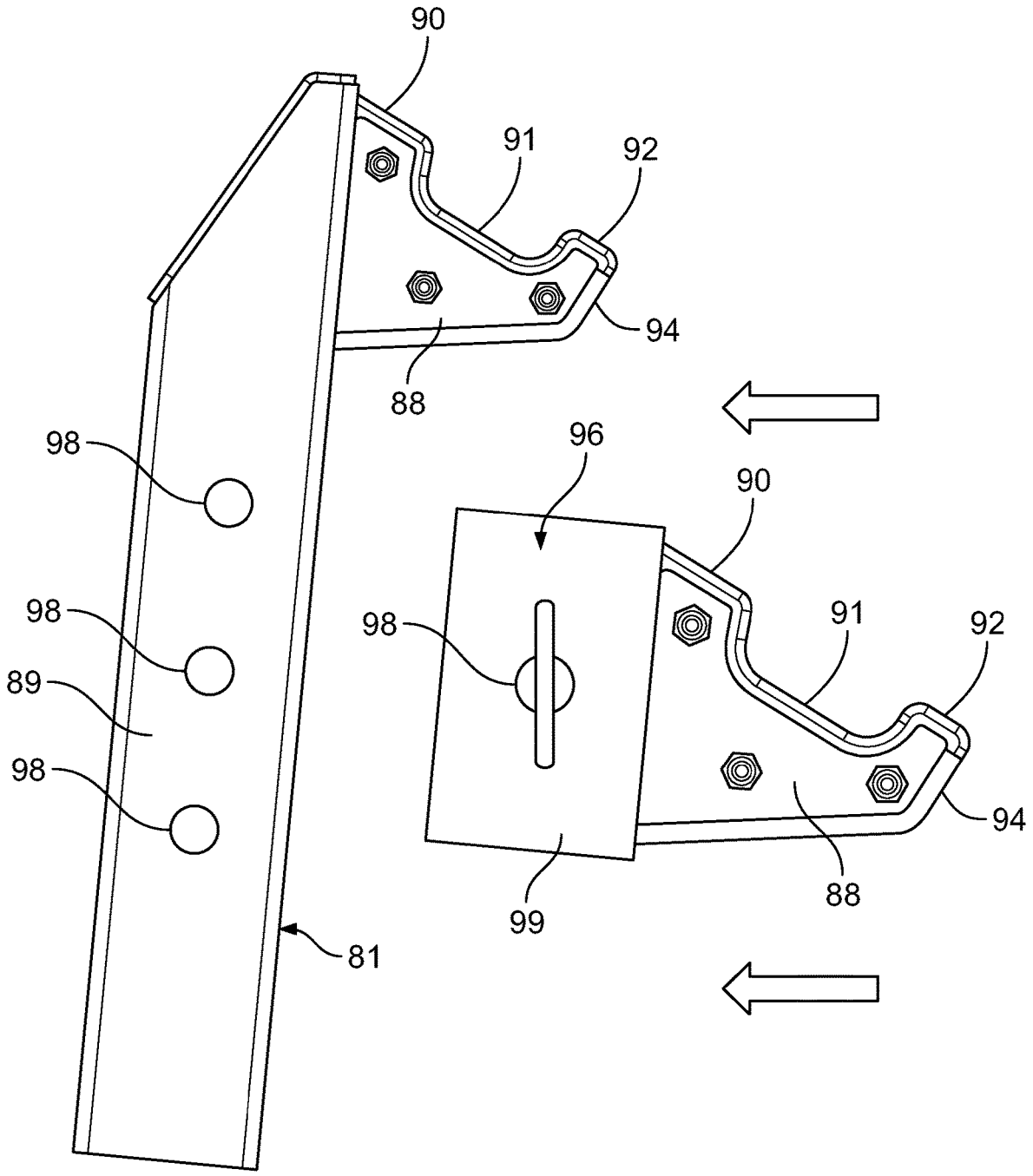
FIG. 20 is a side view of another embodiment of a locking member that is usable in connection with the weightlifting machine of FIG. 1, according to aspects of the disclosure, in a partially disassembled state.
Figure 21:
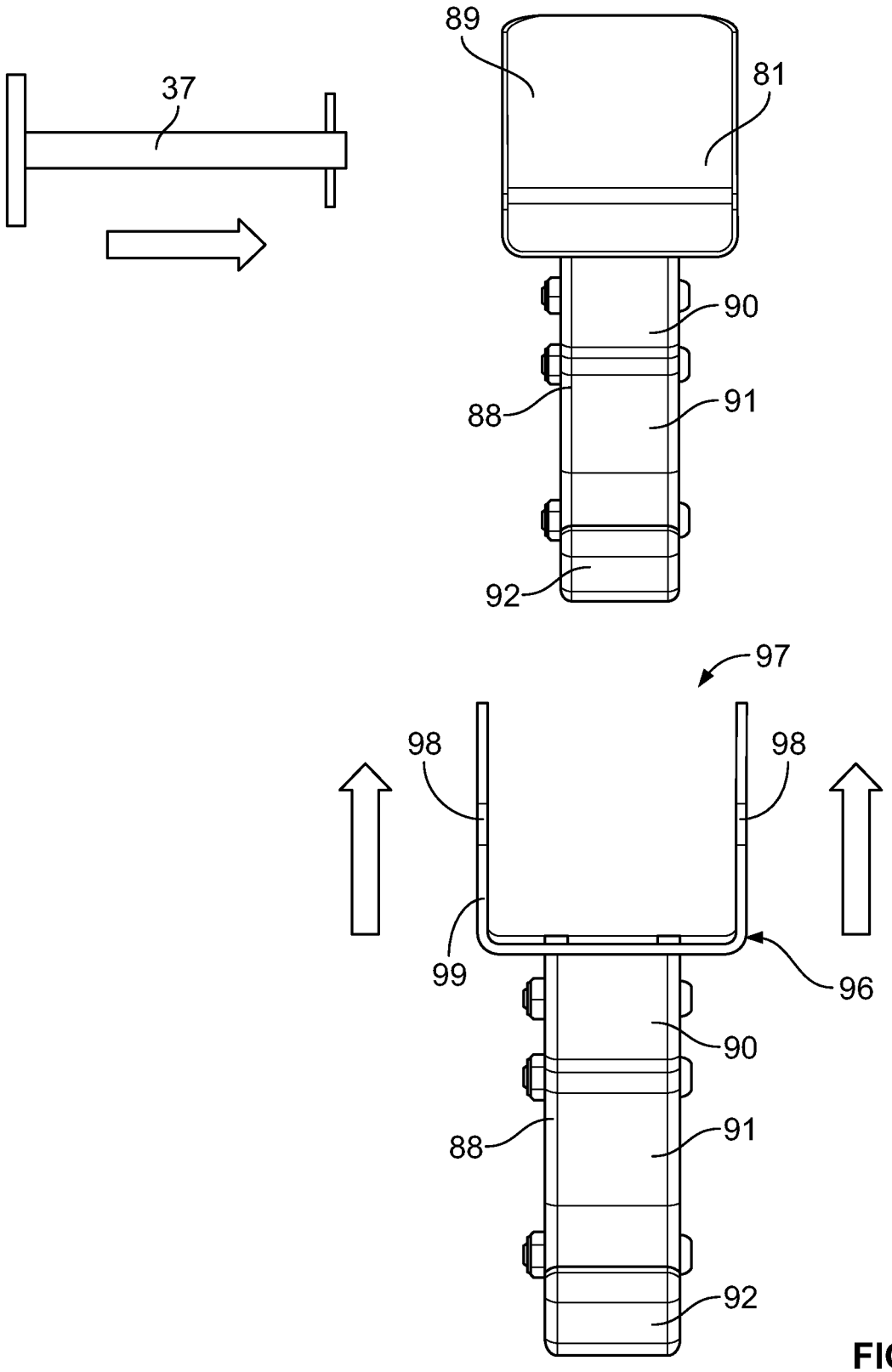
FIG. 21 is a top view of the locking member of FIG. 20.
Figure 22:
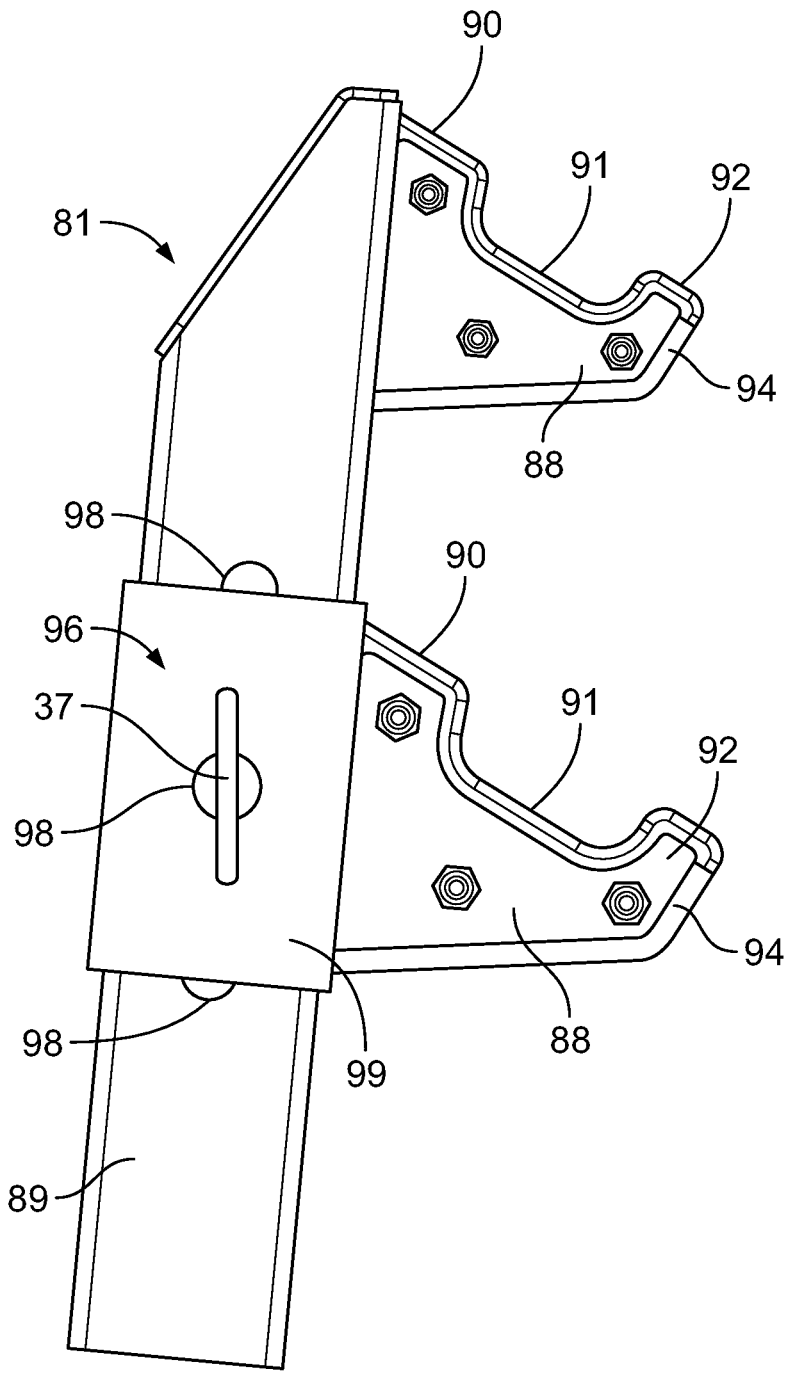
FIG. 22 is a side view of the locking member of FIG. 20 in an assembled state.
Figure 23:
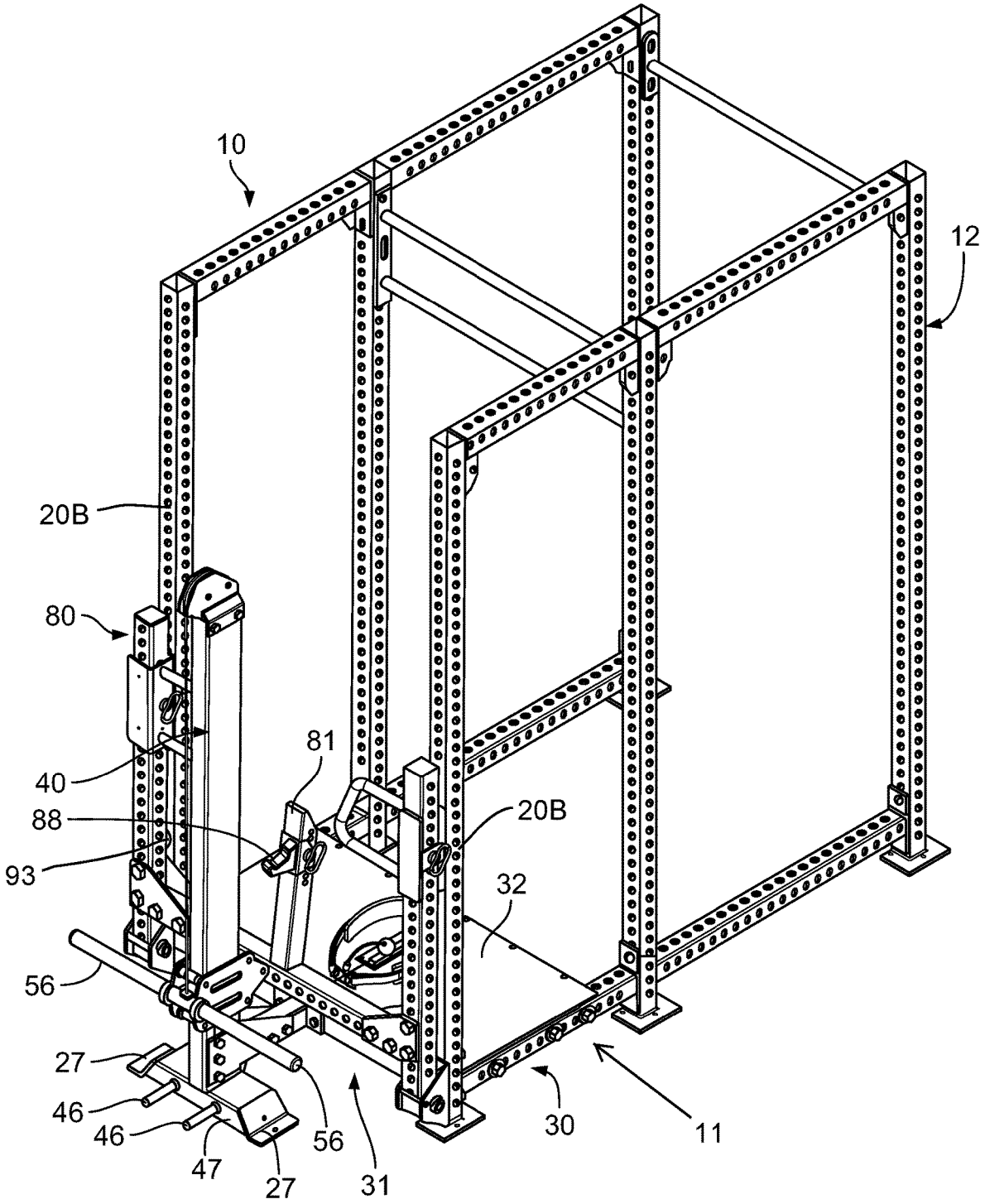
FIG. 23 is a is a rear left perspective view of a weight rack with another embodiment of a weightlifting machine according to aspects of the disclosure, in the form of a squat machine, connected to the weight rack.

FIGS. 20-22 illustrate another embodiment of a locking member 81 that can be used in connection with the locking mechanism 80 in FIGS. 1-15. The locking member 81 in FIGS. 19-20 has a removable and/or adjustable engagement part 88 that can be used to adjust the height of the engagement part 88 based on user preferences or requirements, e.g., the size of the user. In the embodiment of FIGS. 19-20, the locking member includes two engagement parts 88, with an upper engagement part 88 configured and located similarly to the engagement part 88 in FIGS. 1-15 and a second engagement part 88 that includes removable and/or adjustable connection structure 96. The connection structure 96 in FIGS. 20-22 includes a bracket 99 that is connectable to the arm 89 of the locking member 81 by a pin 37 or other fastening member being received through holes 98 in the bracket 99 and the arm 89. As shown in FIGS. 20 and 22, the arm 89 has multiple holes 98 to permit connection of the bracket 99 in multiple different positions at different locations along the arm 89 below the fixed engagement part 88, and the second engagement part 88 is therefore both removable and adjustable. In other embodiments, the second engagement part 88 may only be removable, e.g., by including only a single set of holes 98 on the arm 89, or may only be adjustable, e.g., by having a connection structure 96 with a sliding engagement. In a further embodiment, the locking member 81 may only have a single engagement part 88 that is configured to be removable and/or adjustable, with no fixed engagement part 88. The bracket 99 in FIGS. 20-22 has a C-shape or U-shape and defines a cavity 97 that receives the arm 89 of the locking member 81 therein. The pin 37 in this embodiment is a removable pin with a retaining component, such as a cotter pin or similar component, although other types of pins or fastening devices may be used. It is noted that the second engagement part 88 is configured similarly to the first or fixed engagement part 88 as described above with respect to FIGS. 1-15, having similar structures that are referenced with identical reference numbers. The second engagement part 88 as illustrated in FIGS. 20-22 has a slightly longer length than the fixed engagement part 88, but an otherwise similar structure. It is understood that the locking member 81 may include multiple engagement parts 88 that have different configurations in other embodiments, such as to provide different functionality.

The machine 30 in FIGS. 1-15 is configured for connection to a weight rack assembly 10 to form a supporting assembly 11. FIGS. 16-17 show one example of a rack assembly 10 that includes a frame 12 and a number of weightlifting structures connected to and/or supported by the frame 12, including a squat machine 30, and various body weight exercise supports 18, including bars, handles, and other structures for use in body weight exercises such as chin-ups, climbing, and others. The frame 12 in this embodiment is primarily formed by a plurality of structural support members or frame members 20 in the form of metal bars, which are arranged and connected to each other as vertical beams, horizontal or lateral cross-beams, and angular beams to support the various structures of the rack assembly 10. The frame members 20 in this embodiment are connected to feet 22 to engage the ground. The frame 12 further includes connectors 24 in the form of brackets or other connecting structures for connecting the frame members 20 together to form the frame 12. The frame members 20 as shown in FIGS. 16-17 are formed as square metal tubes with a hollow interior, and having fastener holes 26 arranged at regular intervals along the lengths of all four surfaces of each frame member 20. This arrangement of fastener holes 26 permits fasteners 28 to extend through each frame member 20 in two transverse directions for connection of various components to any side of the frame member 20, including weightlifting structures, other frame members 20, and other structures. Suitable fasteners 28 include pins (including cotter pins or other locking pins), bolts and other threaded connectors, clamps, and other types of fasteners. The rack assembly 10 and frame 12 structured in the manner illustrated in FIGS. 16-17 and described herein permits construction in a modular manner to provide a wide variety of configurations as desired, including customizable sizes, layouts, and supported weightlifting structures. It is understood that the rack assembly 10 may include further supported structures, such as weight racks for holding dumbbells, barbells, and other weights, supports for weights and weightlifting equipment, etc.

The squat machine 30 in FIGS. 1-15 is connected to the rack assembly 10 as shown in FIGS. 16-17 by the use of fasteners 28 that extend through the fastener holes 26 in the frame members 20 of the rack assembly. For example, two frame members 20A run along the left and right sides of the platform 32 and beneath the end portions of the platform 32 and are fastened (e.g., by bolts, screws, or other fasteners) to the two outermost support frame members 34, which run parallel and adjacent to the frame members 20A. The pivot connections 86 of the machine 30 also have surfaces that are fastened to vertical frame members 20B of the rack assembly 10, which may be horizontally spaced substantially equal to the spacing between the vertical members 85 of the pivot body 83. Other connection points may be used as well. This connection permits a squat machine 30 to be incorporated into a weight rack assembly 10 in a compact and convenient manner, reducing the total necessary footprint of the gym. The connection to the rack assembly 10 also further stabilizes the squat machine 30, and shelves can be connected to the rack assembly 10 to provide accessible locations for weight storage close to the machine 30 without interfering with operation of the machine 30.

FIGS. 23-32 illustrate another embodiment of a squat machine 30 and a weight rack 10 connected to the squat machine 30 that include many features that are similar or identical to the features shown and described herein with respect to the embodiments of FIGS. 1-22. Such similar or identical features are identified by the same reference numbers in FIGS. 23-32 and may not be re-described again in detail, or at all, for the sake of brevity. Accordingly, the embodiment of FIGS. 23-32 is primarily described herein with respect to the features of this embodiment that are different from or additional to the features of the embodiments of FIGS. 1-22. It is understood that the various embodiments of squat machines 30 in FIGS. 1-32 may be provided alone or as part of a kit along with components of a weight rack 10 to create an assembly including the weight rack 10 and the squat machine 30 connected thereto. Such a kit may be provided in a fully or partially assembled state or a non-assembled state.

The embodiment of FIGS. 23-32 includes one or more pegs 46 connected to the support frame 31 and extending outwardly from the support frame 31 at the base of the carriage support 40 and below the rear of the weight carriage 50. The support frame 31 includes an enlarged base 47 at the bottom of the carriage support 40 to support the track 41, such that the base 47 rests on the ground and the track 41 extends upward from the base 47. The embodiment of FIGS. 23-25 and 27 includes two pegs 46 that are connected to the base 47 and extend rearwardly from the base 47, such that the pegs 46 are spaced from each other and located on opposite lateral sides of the track 41. In this configuration, the pegs 46 may be used for connection of weights in the form of one or more resistance bands 46A (see FIG. 27) that wrap around the weight mounts 56 to provide resistance for the weight carriage 50. In this configuration, movement of the weight carriage 50 away from the base 47 (i.e., upward) stretches the resistance band(s) 46A to provide weight resistance for the harness 33. The base 47 of the support frame 31 also has two braces 27 on its lateral ends to improve lateral stability of the base 47 and the carriage support 40.

The embodiment of FIGS. 23-32 also has one or more spacers 48 connected to the weight mounts 56 to avoid weights supported by the weight mounts 56 from contacting the carriage 50 during movement. Each weight mount 56 in this embodiment has a spacer 48 in the form of a collar positioned abutting or adjacent to the outer surface of the nearest plate 57 and aligned with the recesses 69 so the beam 68 can pass through both the recesses 69 and the spacers 48. The spacers 48 each have a set screw hole 49 for receiving a set screw (not shown) to fix the spacer in position relative to the weight mount 56 and the carriage 50. The collars 48 may be connected to the carriage 50, such as by welding or other integral joining technique in another embodiment.

Figure 29:
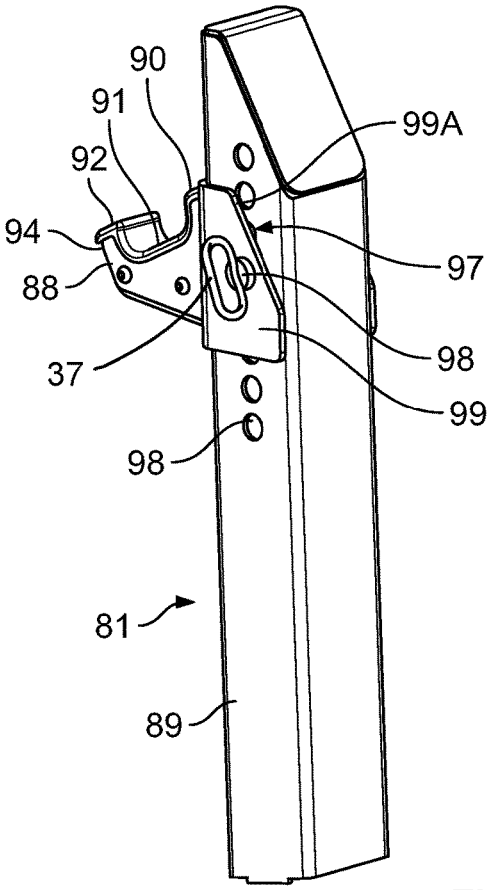
FIG. 29 is a front left perspective view of a locking member of the weightlifting machine of FIG. 24.
Figure 30:
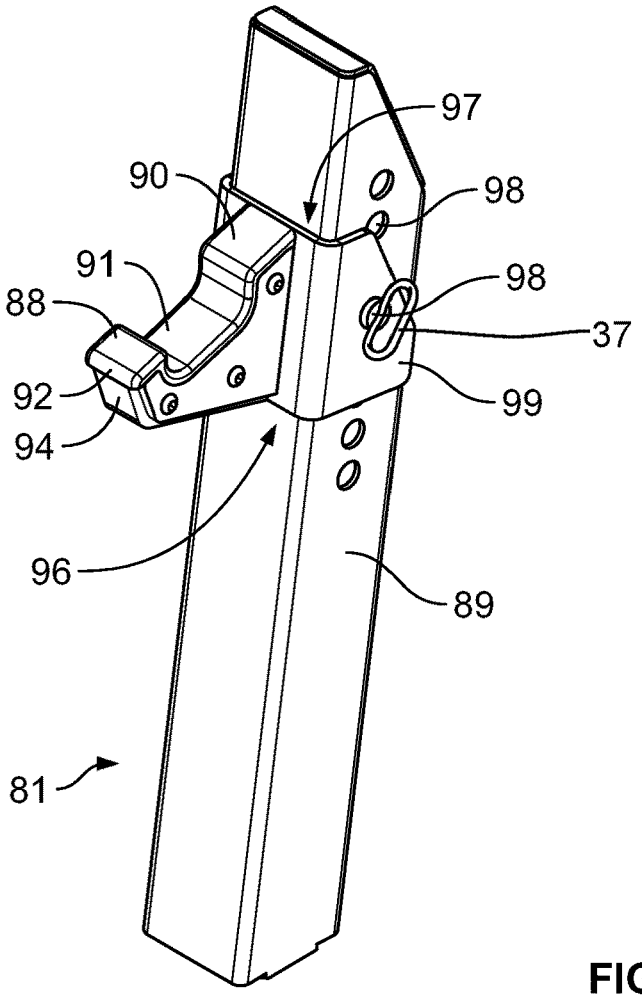
FIG. 30 is a rear left perspective view of the locking member of FIG. 29.
Figure 31:
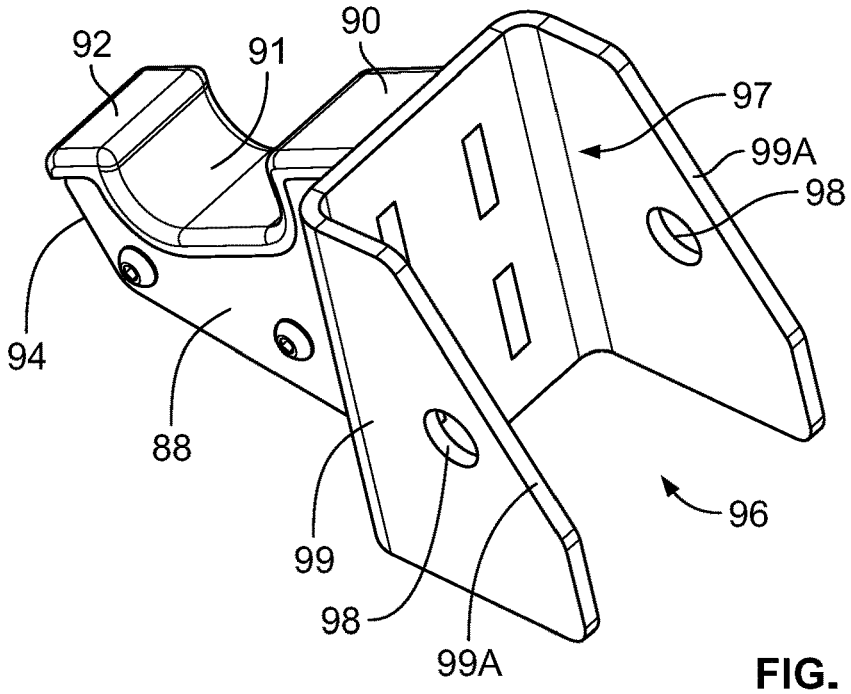
FIG. 31 is a rear left perspective view of an engagement part of the locking member of FIG. 29.
Figure 32:
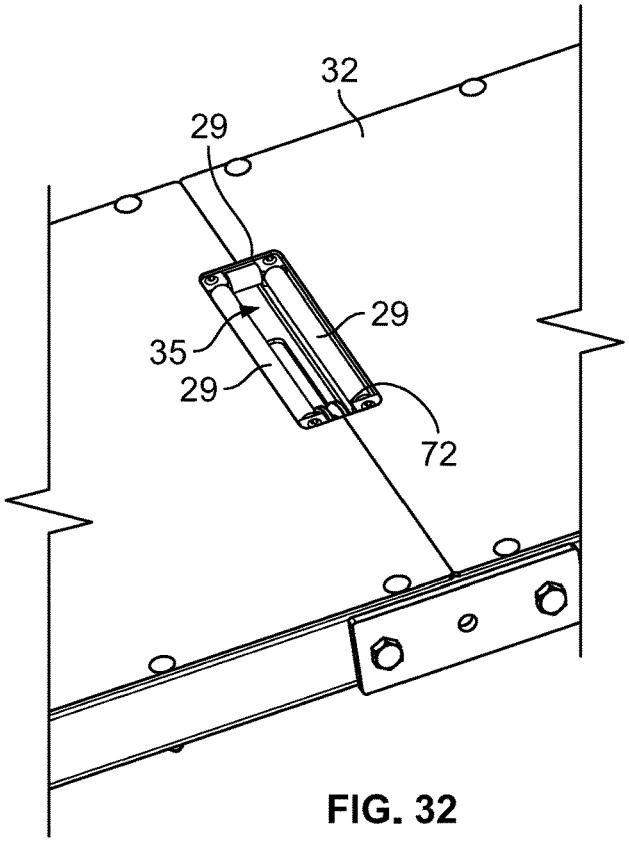
FIG. 32 is a rear right perspective view of a portion of the weightlifting machine of FIG. 24.

FIGS. 23-32 include another embodiment of a locking member 81 that can be used in connection with the locking mechanism 80 in FIGS. 1-15, and the locking member 81 is shown in greater detail in FIGS. 26-27 and 29-32. The locking member 81 in FIGS. 26-27 and 29-32 has a removable and/or adjustable engagement part 88 that can be used to adjust the height of the engagement part 88 based on user preferences or requirements, e.g., the size of the user. The engagement part 88 in FIGS. 26-27 and 29-31 has removable and/or adjustable connection structure 96 that includes a bracket 99 that is connectable to the arm 89 of the locking member 81 by a pin (not shown) or other fastening member being received through holes 98 in the bracket 99 and the arm 89. As shown in FIGS. 29-30, the arm 89 has multiple holes 98 to permit connection of the bracket 99 in multiple different positions at different locations along the arm 89, and the engagement part 88 in this embodiment is therefore both removable and adjustable. In other embodiments, the engagement part 88 may only be removable, e.g., by including only a single set of holes 98 on the arm 89, or may only be adjustable, e.g., by having a connection structure 96 with a sliding engagement. In a further embodiment, the locking member 81 may only have a single engagement part 88 that is configured to be removable and/or adjustable, with no fixed engagement part 88. The bracket 99 in FIGS. 26-27 and 29-31 has a C-shape or U-shape and defines a cavity 97 that receives the arm 89 of the locking member 81 therein, such that the bracket 99 extends around three sides of the arm 89. The bracket 99 also has an angled edge 99A that matches with the beveled shape of the end of the arm 89. The pin in this embodiment may be a removable pin with a retaining component, such as a cotter pin or similar component, similar to the pin 37 shown in FIGS. 21-22 and described herein, although other types of pins or fastening devices may be used. It is noted that the engagement part 88 in FIGS. 26-27 and 29-31 is configured similarly to the fixed engagement part 88 as described above with respect to FIGS. 1-15, having similar structures that are referenced with identical reference numbers.

The embodiment of FIGS. 23-32 also has one or more friction reducing structures along at least a portion of the periphery of the slot 35 that permits the cable 71 to extend through the platform 32 from below, i.e., along one or more edges defining the slot 35. Such friction reducing structure(s) engage the cable 71 as the cable moves through the slot 35 to reduce friction between the cable 71 and the periphery of the slot 35. The friction reducing structures in the embodiment of FIGS. 23-32 are in the form of rollers 29 positioned along three of the sides of the slot 35, as shown in greater detail in FIG. 32. In this embodiment, the slot 35 is elongated between two ends, with the pulley 72 positioned at one of the ends of the slot 35 and the rollers 29 positioned at the opposite end of the slot 35 from the pulley 72 and along the sides of the slot 35 that extend between the two ends. The rollers 29 in this embodiment have smooth surfaces and are freely rotatable about central axes in order to reduce friction between the cable 71 and the edges of the slot 35, to reduce wear and damage to the cable 71 that may occur over the course of many cycles of the cable 71 moving back and forth through the slot 35. In other embodiments, the slot 35 may have differently configured friction reducing structures, such as a different number or arrangement of rollers 29 or smoothly curved stationary surfaces. It is understood that a platform 32 with a slot 35 and friction reducing structures as described herein may be used with a weightlifting machine having a different configuration, such as a cable-based belt squat machine with a moveable weight that is configured differently (e.g., not being mounted on a carriage) or other cable-based weightlifting machine.

FIG. 33 illustrates another embodiment of a squat machine 30 that includes all of the features described herein with respect to FIGS. 23-32, as well as many features that are similar or identical to the features shown and described herein with respect to the embodiments of FIGS. 1-22. Such similar or identical features are identified by the same reference numbers in FIG. 33 and may not be re-described again in detail, or at all, for the sake of brevity. Accordingly, the embodiment of FIG. 33 is primarily described herein with respect to the features of this embodiment that are different from or additional to the features of the embodiments of FIGS. 1-32.

The squat machine 30 in FIG. 33 is configured for stand-alone use without connection to a weight rack 10 or other supporting structure. Thus, the support frame 31 in this embodiment may be considered to constitute the entire support assembly 11. In this embodiment, the support frame 31 of the machine 30 is further provided with a plurality of additional frame members 21, including vertical frame members 21A and horizontal frame members 21B, as well as feet 23 or other ground-engaging structures to permit the machine 30 to rest stably on the ground. The support frame 31 in FIG. 33 has a pair of feet 23 each located at the bottom of one of the vertical frame members 21A, as well as a second pair of feet 23 located at the front of the machine 30 at the ends of bracing arms 25 that extend from the front of the machine 30. In this configuration, the vertical frame members 21A are connected to the support frame 31 by bolting to the front sides of the pivot brackets 86, and the horizontal frame members 21B are connected along the left and right sides of the platform 32 and beneath the end portions of the platform 32 and are fastened (e.g., by bolts, screws, or other fasteners) to the two outermost support frame members 34, which run parallel and adjacent to the frame members 21B, similar to the connection of the frame members 20A in FIGS. 16-17. The bracing arms 25 are connected to the ends of the horizontal frame members 21B, such as by welding or other integral joining technique, and each arm 25 may be part of a single, integral piece with the respective horizontal frame member 21B. In another embodiment, the arms 25 may be connected to the ends of the horizontal frame members 21B or to other structures on the support frame 31 by bolts or other fasteners. As an additional stabilizing structure, the support frame includes braces 27 on the lateral ends of the base 47, as discussed herein.

Various embodiments of weightlifting machines 30 and weight rack assemblies 10 incorporating such machines have been described herein, which include various components and features. In other embodiments, the machine 30 and/or the weight rack assembly 10 may be provided with any combination of such components and features. For example, in one embodiment, certain features of the machine 30 such as the support frame 31, the platform 32, the cable system 70, and/or the locking mechanism 80 may be used in connection with a moveable weight assembly of a different type, such as a moveable weight that does not use a carriage and/or a carriage support. As another example, in one embodiment, the carriage 50 and/or the carriage support 40 may be used in connection with a different type of cable-based weightlifting machine, and the cable system 70 may be routed differently for use with a different weightlifting exercise that may feature a different direction or motion of movement. As a further example, in one embodiment, the machine 30 may be provided without certain features described herein. It is also understood that in other embodiments, the various devices, components, and features of the weightlifting machines 30 and weight rack assemblies 10 described herein may be constructed with similar structural and functional elements having different configurations, including different ornamental appearances.

The configurations of weightlifting machines and the components thereof shown and described herein provide advantages over existing weightlifting machines, particularly when configured as a belt squat machine. The configuration of the carriage and the carriage support provides for smooth, consistent movement during exercise with a variety of different weights, including relatively large amounts of weight. The locking mechanism provides a safe, easy, and reliable way to start a squat exercise in the proper position while allowing free range of movement within a desired exercise range. The cable system and the routing of the cable avoids interference of the cable during the exercise and reduces the potential for damaging the cable during exercise. The configuration of the machine as a whole permits the machine to be provided as a stand-alone unit or easily integrated into a weight rack assembly. Still other advantages are easily recognized by those skilled in the art.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Terms such as "top," "bottom," "front," "back," "side," "rear," "proximal," "distal," and the like, as used herein, are intended for illustrative purposes only and do not limit the embodiments in any way. Nothing in this specification should be construed as requiring a specific three dimensional orientation of structures in order to fall within the scope of this invention, unless explicitly specified by the claims. "Integral joining technique," as used herein, means a technique for joining two pieces so that the two pieces effectively become a single, integral piece, including, but not limited to, irreversible joining techniques such as welding, brazing, soldering, or the like, where separation of the joined pieces cannot be accomplished without structural damage thereto. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. A weightlifting machine comprising:

a user-engaging device configured to be engaged by a user during an exercise on the weightlifting machine;

a carriage support comprising a track extending upward from a base;

a carriage moveably mounted on the carriage support and configured to move vertically along the track, wherein the carriage is configured for engaging a weight for resistance against vertical movement;

a cable system comprising a cable operably connected to the user-engaging device and the carriage and one or more pulleys connected to the weightlifting machine to guide a path of the cable, such that movement of the user-engaging device by the user during the exercise moves the carriage vertically along the track via the cable system; and a locking mechanism comprising a locking member that is moveable between a locking position, where the locking member engages the carriage and supports the carriage at an elevated position above a lowermost position of the carriage, and a release position, where the locking member does not engage the carriage, and the carriage is free to move below the elevated position, wherein the locking member is moveable by pivoting between the locking position and the release position, and wherein the locking member includes an engagement part configured to engage and support the carriage at the elevated position, the engagement part having a notch configured to receive an engagement member of the carriage.

2. The weightlifting machine of claim 1, wherein the carriage comprises a weight mount configured for engaging the weight when the weight is in the form of a free weight supported by the weight mount.

3. The weightlifting machine of claim 1, wherein the carriage comprises a weight mount configured for engaging the weight when the weight is in the form of a resistance band, and wherein the base has a peg extending outwardly from the base, and wherein the peg and the weight mount are configured to engage the resistance band such that movement of the carriage away from the base stretches the resistance band.

4. The weightlifting machine of claim 1, further comprising:

a platform configured to support the user during the exercise; and a supporting assembly supporting the platform, wherein at least the base of the carriage support is connected to the supporting assembly, and wherein the locking mechanism is connected to the supporting assembly.

5. The weightlifting machine of claim 1, wherein the carriage support comprises an upright rail defining the track, wherein the upright rail is hollow, and the cable of the cable system has an ascending cable section extending vertically within the hollow upright rail.

6. The weightlifting machine of claim 1, wherein the locking mechanism further comprises a pivot connection configured for connection to a supporting assembly and a pivoting body connected to the pivot connection such that the locking mechanism is pivotable about the pivot connection, wherein the locking member is connected to the pivoting body and extends upward from the pivoting body.

7. The weightlifting machine of claim 6, wherein the pivoting body includes a base member that extends horizontally and a vertical member connected to the base member and extending upward from the base member, wherein the vertical member has a handle configured for gripping by a user to pivot the locking mechanism between the locking position and the release position.

8. The weightlifting machine of claim 7, wherein the pivoting body further includes a second vertical member connected to the base member and extending upward from the base member, wherein the second vertical member has a second handle configured for gripping by a user to pivot the locking mechanism between the locking position and the release position, and wherein the vertical member is spaced from the second vertical member, and the locking member is positioned between the vertical member and the second vertical member.

9. The weightlifting machine of claim 8, wherein the vertical member is connected to the pivot connection, and the locking mechanism further comprises a second pivot connection, and the second vertical member is connected to the second pivot connection such that the locking mechanism is pivotable about the pivot connection and the second pivot connection, and wherein the base member extends horizontally between the vertical member and the second vertical member.

10. A weightlifting machine comprising:

a carriage support comprising a track;

a carriage moveably mounted on the carriage support and configured to move vertically along the track, wherein the carriage is configured for engaging a weight for resistance against vertical movement during an exercise on the weightlifting machine;

a locking mechanism comprising a locking member that is moveable by pivoting between a locking position, where the locking member engages the carriage and supports the carriage at an elevated position above a lowermost position of the carriage, and a release position, where the locking member does not engage the carriage, and the carriage is free to move below the elevated position;

a user-engaging device configured to be engaged by a user during the exercise;

a cable system comprising a cable operably connected to the user-engaging device and the carriage, such that movement of the user-engaging device by the user during the exercise moves the carriage vertically along the track via the cable system;

a platform configured to support the user during the exercise; and a supporting assembly supporting the platform, wherein the locking mechanism further comprises a pivot connection connected to the supporting assembly and a pivoting body connected to the pivot connection such that the locking mechanism is pivotable about the pivot connection, wherein the locking member is connected to the pivoting body.

11. The weightlifting machine of claim 10, wherein the locking member extends upward from the pivoting body.

12. The weightlifting machine of claim 11, wherein the pivoting body includes a base member that extends horizontally and a vertical member connected to the base member and extending upward from the base member, wherein the vertical member has a handle configured for gripping by a user to pivot the locking mechanism between the locking position and the release position.

13. The weightlifting machine of claim 12, wherein the pivoting body further includes a second vertical member connected to the base member and extending upward from the base member, wherein the second vertical member has a second handle configured for gripping by a user to pivot the locking mechanism between the locking position and the release position, and wherein the vertical member is spaced from the second vertical member, and the locking member is positioned between the vertical member and the second vertical member.

14. The weightlifting machine of claim 13, wherein the vertical member is connected to the pivot connection, and the locking mechanism further comprises a second pivot connection, and the second vertical member is connected to the second pivot connection such that the locking mechanism is pivotable about the pivot connection and the second pivot connection, and wherein the base member extends horizontally between the vertical member and the second vertical member.

15. The weightlifting machine of claim 11, wherein the locking member comprises an engagement part configured to engage and support the carriage at the elevated position, the engagement part having a notch configured to receive an engagement member of the carriage.

16. The weightlifting machine of claim 10, further comprising a supporting assembly supporting the platform, the supporting assembly comprising a vertical frame member, wherein the pivot connection is connected to the supporting assembly, and wherein the vertical frame member is configured to abut the pivot body to limit a range of motion of the locking mechanism away from the locking position.

17. The weightlifting machine of claim 10, wherein the locking mechanism further comprises motion limiting structures configured to limit a range of motion of the locking mechanism away from the locking position and away from the release position.

18. A weightlifting machine comprising:

a carriage support;

a carriage moveably mounted on the carriage support and configured to move vertically on the carriage support, wherein the carriage is configured for engaging a weight for resistance against vertical movement during an exercise on the weightlifting machine;

a locking mechanism comprising a base member, a locking member having an arm extending upward from the base member and an engagement part connected to the arm, and a vertical member connected to the base member and extending upward from the base member, the vertical member having a handle, wherein the locking mechanism is moveable by manipulation of the handle to move the locking member between a locking position, where the engagement part engages the carriage and supports the carriage at an elevated position above a lowermost position of the carriage, and a release position, where the engagement part does not engage the carriage, and the carriage is free to move below the elevated position;

a user-engaging device configured to be engaged by a user during the exercise;

a cable system comprising a cable operably connected to the user-engaging device and the carriage, such that movement of the user-engaging device by the user during the exercise moves the carriage vertically along the carriage support via the cable system;

a platform configured to support the user during the exercise; and a supporting assembly supporting the platform, wherein the locking mechanism is moveably connected to the supporting assembly.

19. The weightlifting machine of claim 18, wherein the locking mechanism further comprises a second vertical member connected to the base member and extending upward from the base member, wherein the second vertical member has a second handle configured for gripping by a user to move the locking mechanism between the locking position and the release position, and wherein the vertical member is spaced from the second vertical member.

20. The weightlifting machine of claim 19, wherein the locking member is positioned between the vertical member and the second vertical member.

21. The weightlifting machine of claim 19, wherein the base member extends horizontally between the vertical member and the second vertical member.

22. The weightlifting machine of claim 18, wherein the engagement part has a notch configured to receive an engagement member of the carriage.

23. The weightlifting machine of claim 18, wherein the engagement part extends outwardly from the arm.

24. The weightlifting machine of claim 18, wherein the engagement part is adjustably connected to the arm, such that the engagement part is configured to be mounted at a plurality of different positions along a length of the arm.

* * * * *